US011389685B2

(12) United States Patent
Lagree et al.

(10) Patent No.: US 11,389,685 B2
(45) **Date of Patent: *Jul. 19, 2022**

(54) EXERCISE MACHINE WITH RESISTANCE SELECTOR SYSTEM

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/306,121

(22) Filed: May 3, 2021

(65) Prior Publication Data

US 2021/0252324 A1 Aug. 19, 2021

Related U.S. Application Data

(63) Continuation of application No. 16/703,168, filed on Dec. 4, 2019, now Pat. No. 10,994,168.
(Continued)

(51) Int. Cl.
*A63B 21/00* (2006.01)
*A63B 21/005* (2006.01)
(Continued)

(52) U.S. Cl.
CPC .... *A63B 21/00069* (2013.01); *A63B 21/0056* (2013.01); *A63B 21/023* (2013.01);
(Continued)

(58) Field of Classification Search
CPC ..... A63B 1/023; A63B 1/0407; A63B 1/0428; A63B 1/4045; A63B 22/0087–0089; A63B 22/20–203
See application file for complete search history.

(56) References Cited

U.S. PATENT DOCUMENTS 131,886 A 10/1872 Little
339,638 A 4/1886 Goldie
(Continued)

FOREIGN PATENT DOCUMENTS

JP 106278 A 1/1998
KR 1020040097734 B1 11/2004
(Continued)

OTHER PUBLICATIONS http://www.puzzlebox.io/brainstorms/; Puzzlebox Brainstorms Website Article; Jun. 13, 2016.
(Continued)

*Primary Examiner* — Jennifer Robertson
(74) *Attorney, Agent, or Firm* — Neustel Law Offices

(57) ABSTRACT

An exercise machine with resistance selector system for selecting the number of bias members applying a resistance force against a movable platform. The exercise machine with resistance selector system generally includes one or more switches which are connected to the movable platform. Each of the one or more switches is adapted to engage or disengage a corresponding latch. When engaged, the latch will connect a corresponding bias member to the movable platform. When disengaged, the latch will disconnect a corresponding bias member from the movable platform. In this manner, an exerciser may easily adjust the number of bias members connected to the movable platform so as to adjust the resistance force applied against movement of the movable platform along a rail.

20 Claims, 16 Drawing Sheets

Related U.S. Application Data

(60) Provisional application No. 62/775,034, filed on Dec. 4, 2018.

(51) Int. Cl.
*A63B 22/20* (2006.01)
*A63B 21/04* (2006.01)
*A63B 21/02* (2006.01)

(52) U.S. Cl.
CPC ..... *A63B 21/0407* (2013.01); *A63B 21/4033* (2015.10); *A63B 21/4035* (2015.10); *A63B 21/4045* (2015.10); *A63B 22/203* (2013.01); *A63B 2225/20* (2013.01)

(56) References Cited

U.S. PATENT DOCUMENTS 1,621,477 A 8/1925 Pilates
3,770,267 A 11/1973 McCarthy
3,806,094 A 4/1974 Harken
4,013,068 A 3/1977 Settle
4,759,540 A 7/1988 Yu
4,798,378 A 1/1989 Jones
5,066,005 A 11/1991 Luecke
5,201,694 A 4/1993 Zappel
5,263,913 A 11/1993 Boren
5,295,935 A 3/1994 Wang
5,316,535 A 5/1994 Bradbury
5,365,934 A 11/1994 Leon
D362,700 S 9/1995 Breibart
D382,319 S 8/1997 Gerschefske
5,681,249 A 10/1997 Endelman
5,738,104 A 4/1998 Lo
5,812,978 A 9/1998 Nolan
5,885,197 A 3/1999 Barton
5,967,955 A 10/1999 Westfall
5,989,163 A 11/1999 Rodgers, Jr.
6,045,491 A * 4/2000 McNergney ..... A63B 22/0087 482/121
6,152,856 A 11/2000 Studor
6,179,753 B1 1/2001 Barker
6,261,205 B1 7/2001 Elefson
6,626,802 B1 9/2003 Rodgers, Jr.
6,790,162 B1 9/2004 Ellis
6,790,163 B1 9/2004 Van De Laarschot
6,929,589 B1 8/2005 Bruggemann
7,108,635 B2 9/2006 Howlett-Campanella
7,163,500 B2 1/2007 Endelman
7,192,387 B2 3/2007 Mendel
7,448,986 B1 11/2008 Porth
7,537,554 B2 5/2009 Zhuang
7,803,095 B1 9/2010 Lagree
7,871,359 B2 1/2011 Humble
7,878,955 B1 2/2011 Ehrlich
7,914,420 B2 3/2011 Daly
7,931,570 B2 4/2011 Hoffman
7,967,728 B2 6/2011 Zavadsky
8,162,802 B2 4/2012 Berg
8,249,714 B1 8/2012 Hartman
8,287,434 B2 10/2012 Zavadsky
8,303,470 B2 11/2012 Stewart
8,500,611 B2 8/2013 Hoffman
8,585,554 B2 * 11/2013 Shavit ..... A63B 21/0557 482/121
8,641,585 B2 2/2014 Lagree
8,812,075 B2 8/2014 Nguyen
8,852,062 B2 10/2014 Dorsay
8,911,328 B2 12/2014 Alessandri
9,011,291 B2 4/2015 Birrell
9,022,909 B2 5/2015 Kermath
9,199,123 B2 12/2015 Solow
9,283,422 B2 3/2016 Lagree
9,533,184 B1 1/2017 Lagree
10,046,193 B1 8/2018 Aronson
10,155,129 B2 12/2018 Lagree
2001/0056011 A1 12/2001 Endelman
2002/0025888 A1 2/2002 Germanton
2002/0025891 A1 2/2002 Colosky, Jr.
2002/0082146 A1 6/2002 Steams
2002/0137607 A1 9/2002 Endelman
2003/0119635 A1 6/2003 Arbuckle
2004/0043873 A1 3/2004 Wilkinson
2005/0085351 A1 4/2005 Kissel
2005/0130810 A1 6/2005 Sands
2005/0164853 A1 7/2005 Naidus
2005/0164856 A1 7/2005 Parmater
2006/0046914 A1 3/2006 Endelman
2006/0105889 A1 5/2006 Webb
2006/0183606 A1 8/2006 Parmater
2006/0199712 A1 9/2006 Barnard
2007/0202992 A1 8/2007 Grasshoff
2007/0224582 A1 9/2007 Hayashino
2007/0270293 A1 11/2007 Zhuang
2008/0051256 A1 2/2008 Ashby
2008/0058174 A1 3/2008 Barnard
2008/0070765 A1 3/2008 Brown
2008/0139975 A1 6/2008 Einav
2008/0242519 A1 10/2008 Parmater
2008/0248935 A1 10/2008 Solow
2008/0254952 A1 10/2008 Webb
2009/0005698 A1 1/2009 Lin
2009/0023561 A1 1/2009 Ross
2009/0291805 A1 11/2009 Blum
2009/0312152 A1 12/2009 Kord
2010/0016131 A1 1/2010 Hoffman
2010/0125026 A1 5/2010 Zavadsky
2010/0144499 A1 6/2010 Graham
2010/0227748 A1 9/2010 Campanaro
2010/0267524 A1 10/2010 Stewart
2011/0018233 A1 1/2011 Senner
2011/0039665 A1 2/2011 Dibble
2011/0077127 A1 3/2011 Ishii
2011/0143898 A1 6/2011 Trees
2011/0152045 A1 6/2011 Home
2011/0166002 A1 7/2011 Savsek
2011/0172069 A1 7/2011 Gerschefske
2011/0184559 A1 7/2011 Benabid
2012/0015334 A1 1/2012 Hamilton
2012/0088634 A1 4/2012 Heidecke
2012/0143020 A1 6/2012 Bordoley
2012/0190505 A1 7/2012 Shavit
2012/0202656 A1 8/2012 Dorsay
2012/0228385 A1 9/2012 DeLuca
2012/0295771 A1 11/2012 Lagree
2013/0072353 A1 3/2013 Alessandri
2013/0150216 A1 6/2013 Bell
2013/0196835 A1 8/2013 Solow
2013/0210578 A1 8/2013 Birrell
2013/0289889 A1 10/2013 Yuen
2014/0011645 A1 1/2014 Johnson
2014/0066257 A1 3/2014 Shavit
2014/0087922 A1 3/2014 Bayerlein
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2014/0148715 A1 5/2014 Alexander
2014/0213415 A1 7/2014 Parker
2015/0012111 A1 1/2015 Contreras-Vidal
2015/0024914 A1 1/2015 Lagree
2015/0057127 A1 2/2015 Lagree
2015/0065318 A1 3/2015 Lagree
2015/0072841 A1 3/2015 Lagree
2015/0105223 A1 4/2015 Bissu
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0329011 A1 11/2015 Kawai
2015/0343250 A1 12/2015 Lagree
2015/0360068 A1 12/2015 Lagree

(56) References Cited

U.S. PATENT DOCUMENTS

| | | | |
|---|---|---|---|
| 2015/0360083 | A1 | 12/2015 | Lagree |
| 2015/0360113 | A1 | 12/2015 | Lagree |
| 2015/0364058 | A1 | 12/2015 | Lagree |
| 2015/0364059 | A1 | 12/2015 | Marks |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0074691 | A1 | 3/2016 | Pearce |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2018/0178053 | A1 | 6/2018 | Lagree |
| 2018/0193691 | A1 | 7/2018 | Lagree |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1 | 11/2018 | Lagree |
| 2018/0318646 | A1 | 11/2018 | Lagree |
| 2018/0326252 | A1 | 11/2018 | Lagree |

FOREIGN PATENT DOCUMENTS

| | | | |
|---|---|---|---|
| WO | 2004096376 | A1 | 11/2004 |
| WO | 2014084742 | A1 | 6/2014 |

OTHER PUBLICATIONS http://tera.lunar-europe.com; TERA Fitness Mat; Lunar Europe; Jun. 8, 2014.

PCT International Search and Opinion from International Searching Authority for PCT/US2016/022888; dated Jul. 25, 2016.

PCT Preliminary Report on Patentability from International Searching Authority for PCT/US2016/022888; dated Sep. 28, 2017.

PCT International Search and Opinion from International Searching Authority for PCT/US2017/041638; dated Sep. 28, 2017.

http://www.cognionics.com/index.php/products/hd-eeg-systems/mobile-eeg-cap; Cognionics Mobile-72 Wireless EEG System; Jun. 14, 2016.

http://www.cognionics.com/index.php/products/mini-systems/dry-eeg-headband; Cognionics Dry EEG Headband; Jun. 14, 2016.

http://www.cognionics.com/index.php/products/mini-systems/multi-position-dry-headband; Cognionics Multi-Position Dry EEG Headband; Jun. 14, 2016.

http://www.cognionics.com/index.php/products/hd-eeg-systems/quick-20-dry-headset; Cognionics Quick-20 Dry EEG Headset; Jun. 14, 2016.

http://www.cognionics.com/index.php/products/hd-eeg-systems/72-channel-system; Cognionics HD-72 Overview; Jun. 14, 2016.

http://www.brainproducts.com/productdetails.php?id=63&tab=1; LiveAmp Overview; Jun. 14, 2016.

https://www.youtube.com/watch?v=xj2xuGsB3yo; Screenshot of YouTube Video "Iphone free App (Dec. 16, 2010) Finger Balance"; Tuuske; Dec. 16, 2010.

PCT International Search Report and Written Opinion for PCT/US2015/047746 from the Korean Intellectual Property Office; dated Nov. 19, 2015.

PCT International Search Report and Written Opinion for PCT/US2015/047763 from the Korean Intellectual Property Office; dated Nov. 19, 2015.

PCT Preliminary Report on Patentability from International Searching Authority for PCT/US2017/041638; dated Jan. 24, 2019.

* cited by examiner

SOLENOID - ON

*FIG. 20*

210 213 212 211

| Total Exercise Resistance (starting pounds equivalent) | Manifold Switch Number and Weight Equivalent (Manual and/or Remote Engaged On) | | | | | | | |
|---|---|---|---|---|---|---|---|---|
| | Switch #1 (8 lb) | Switch #2 (48 lb) | Switch #3 (8 lb) | Switch #4 (48 lb) | Switch #5 (8 lb) | Switch #6 (48 lb) | Switch #7 (8 lb) | Switch #8 (8 lb) |
| 8 | ON | --- | --- | --- | --- | -- | --- | --- |
| 16 | ON | --- | ON | --- | --- | --- | --- | --- |
| 24 | ON | --- | ON | --- | ON | --- | --- | --- |
| 32 | ON | --- | ON | --- | ON | | ON | --- |
| 40 | ON | --- | ON | --- | ON | | ON | ON |
| 48 | --- | ON | --- | --- | --- | --- | --- | --- |
| 56 | ON | ON | --- | --- | --- | --- | --- | --- |
| 64 | ON | ON | ON | --- | --- | --- | --- | --- |
| 72 | ON | ON | ON | --- | ON | --- | --- | --- |
| 80 | ON | ON | ON | --- | ON | --- | ON | --- |
| 88 | ON | ON | ON | --- | ON | --- | ON | ON |
| 96 | --- | ON | --- | ON | --- | --- | --- | --- |
| 104 | ON | ON | --- | --- | --- | --- | --- | --- |
| 112 | ON | ON | ON | --- | --- | --- | --- | --- |
| 120 | ON | ON | ON | --- | ON | --- | --- | --- |
| 128 | ON | ON | ON | --- | ON | --- | ON | --- |
| 136 | ON | ON | ON | ON | ON | --- | ON | ON |
| 144 | --- | ON | --- | ON | --- | ON | --- | --- |
| 152 | ON | ON | --- | ON | --- | ON | --- | --- |
| 160 | ON | ON | ON | ON | --- | ON | --- | --- |
| 168 | ON | ON | ON | ON | ON | ON | --- | --- |
| 176 | ON | ON | ON | ON | ON | ON | ON | --- |
| 184 | ON | ON | ON | ON | ON | ON | ON | ON |

EXERCISE MACHINE WITH RESISTANCE SELECTOR SYSTEM

CROSS REFERENCE TO RELATED APPLICATIONS

The present application is a continuation of U.S. application Ser. No. 16/703,168 filed on Dec. 4, 2019 which issues as U.S. Pat. No. 10,994,168 on May 4, 2021, which claims priority to U.S. Provisional Application No. 62/775,034 filed Dec. 4, 2018. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine with resistance selector system for use in the field of fitness training devices and exercise machines. More specifically, a resistance training machine provides for a longitudinally movable platform slidable along and parallel to one or more stationary rails extending substantially the length of the machine, with a plurality of biasing members removably attached between the stationary machine structure and the movable platform, the biasing members thereby inducing a unidirectional resistance force against the movable platform.

Exemplary embodiments described herein may provide for methods and systems for detaching or attaching one or more of a plurality of bias members from or to a movable platform at any time during exercise, and further may provide for an exercise class instructor to remotely attach or detach one or more bias members from a movable platform on one or more exercise machines in the class.

Related Art

Any discussion of the related art throughout the specification should in no way be considered as an admission that such related art is widely known or forms part of common general knowledge in the field.

Those skilled in the art will appreciate that traditional resistance exercise machines with a sliding, substantially horizontal exercise platform are engineered to provide for resistance training by moving a slidable exercise platform reciprocally along one or more longitudinal rails that guide the platform's linear movement during exercise. A variable resistance force may be exerted upon the movable carriage by bias members which typically comprise a plurality of extension springs that are each removably attachable between the movable platform and the stationary structure of the machine.

Traditional machines as just described generally require an exerciser to manually attach the removably attachable end of at least one spring to the movable carriage. Thereafter, the exerciser may slide the movable carriage along the one or more longitudinal rails in a direction which lengthens the attached one or more springs so as to exert the spring resistance force against the movable platform. The process of exercisers stopping to continually attach and/or detach a plurality of springs manually during and throughout an exercise class may cause a considerable disruption to the class, and may consume valuable exercise class time that otherwise could be used for exercising. Further, the resistance force may not be changed by an exerciser or exercise class instructor while the platform is moving.

SUMMARY

An example embodiment is directed to an exercise machine with resistance selector system. The exercise machine with resistance selector system includes a resistance exercise machine comprising a plurality of resistance springs; each spring being engaged or disengaged from a reciprocating exercise platform by one or more slide switches. The slide switches may be manipulated manually, or by actuators that extend or retract in response to instructions received from a controller.

The engagement or disengagement of any resistance spring to or from a reciprocating platform may be prevented during the performance of an exercise unless the reciprocating platform is at least momentarily stopped at the default starting point of the reciprocating cycle, regardless of when controller instructions are received, or regardless of when a switch is manually manipulated by the exerciser. Further, any actuator may override any manually engaged or disengaged switch, permitting the manual override of any actuator engaged or disengaged switch.

There has thus been outlined, rather broadly, some of the embodiments of the exercise machine with resistance selector system in order that the detailed description thereof may be better understood, and in order that the present contribution to the art may be better appreciated. There are additional embodiments of the exercise machine with resistance selector system that will be described hereinafter and that will form the subject matter of the claims appended hereto. In this respect, before explaining at least one embodiment of the exercise machine with resistance selector system in detail, it is to be understood that the exercise machine with resistance selector system is not limited in its application to the details of construction or to the arrangements of the components set forth in the following description or illustrated in the drawings. The exercise machine with resistance selector system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 20 is an exemplary diagram showing a resistance selection table in accordance with an example embodiment.

DETAILED DESCRIPTION

A. Overview.

Figure 1:
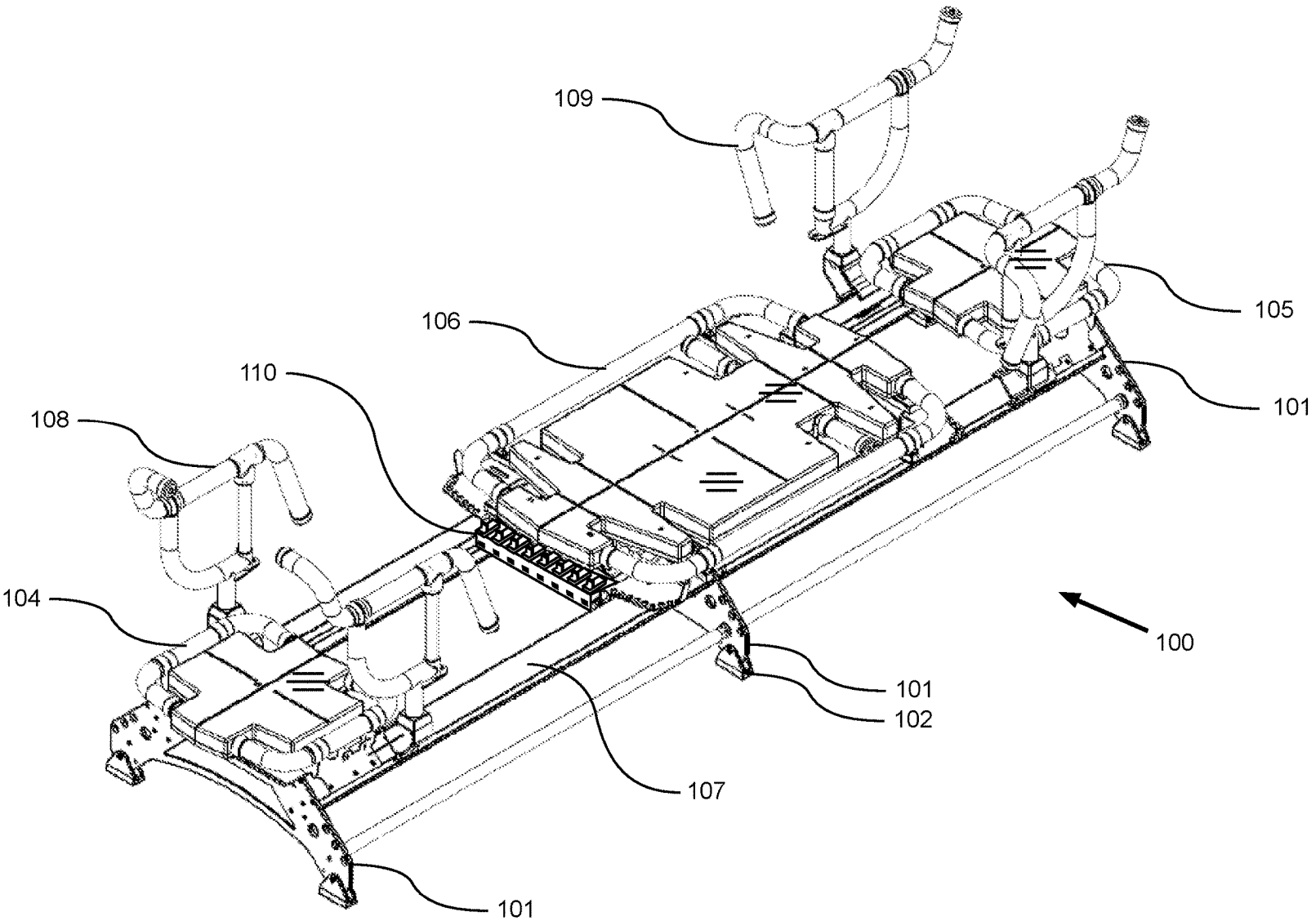
FIG. 1 is an exemplary diagram showing an isometric view of an improved exercise machine in accordance with an example embodiment.
Figure 9:
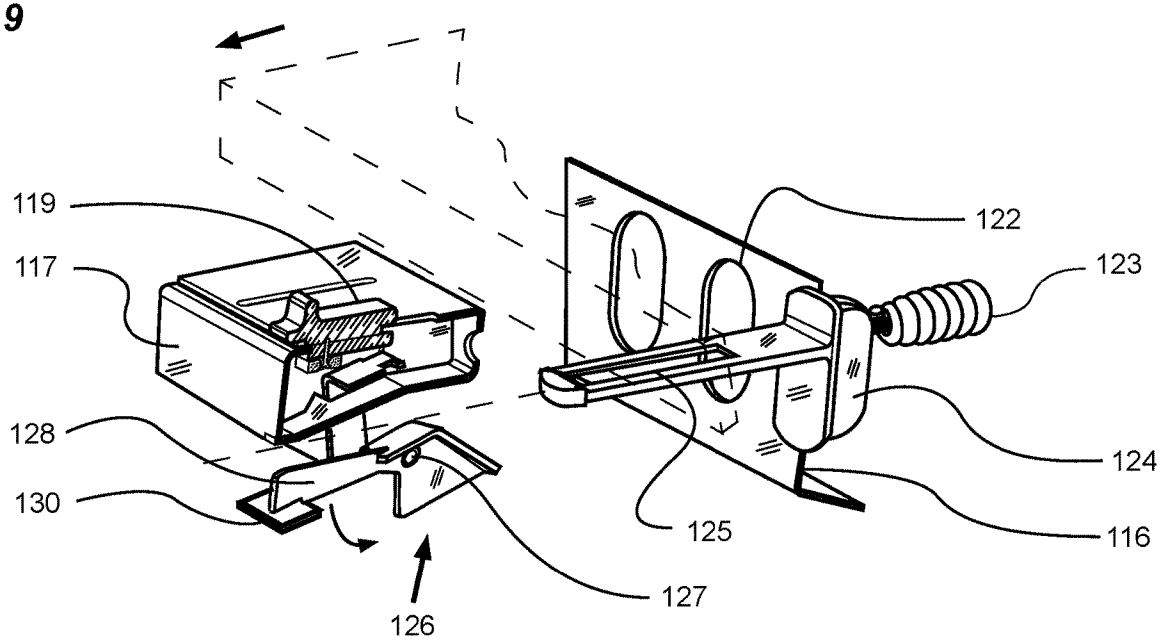
FIG. 9 is an exemplary diagram showing a sectional isometric view of a manual resistance selector switch in the disengaged position in operation in accordance with an example embodiment.
Figure 10:
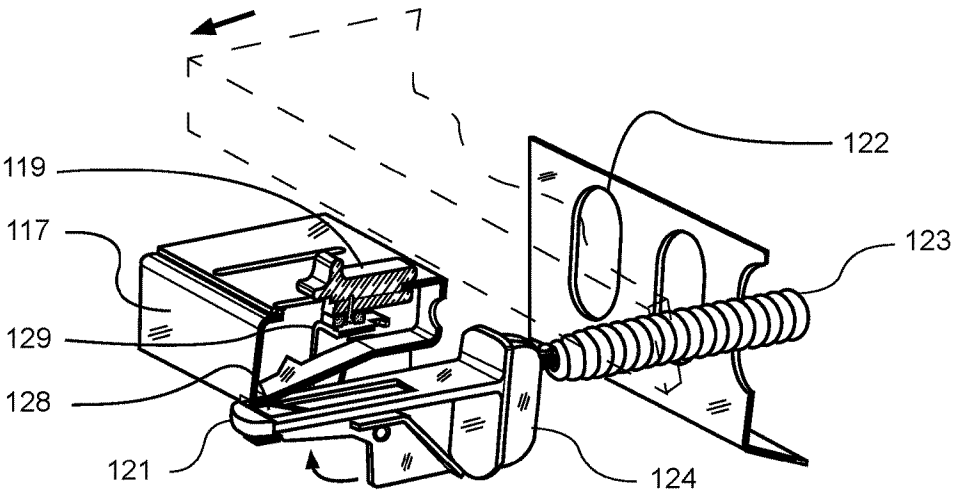
FIG. 10 is an exemplary diagram showing a sectional isometric view of a manual resistance selector switch in the engaged position in operation in accordance with an example embodiment.

FIGS. 1-5 illustrate an example exercise machine 100 with resistance selector system which generally comprises a frame having a first end and a second end opposite the first end, wherein the frame includes a rail 107 having a first end and a second end opposite the first end. As shown in FIG. 1, a first stationary platform 104 is connected to the frame and positioned near the first end of the frame. As shown in FIGS. 2A and 2B, a movable platform 106 is movably positioned upon the rail 107, wherein the movable platform 106 is adapted to slide along the rail 107 and wherein the movable platform 106 comprises a first end and a second end opposite the first end of the movable platform 106. As shown in FIGS. 9 and 10, a first bias member 115 is selectively connectable to the movable platform 106 to apply a first resistance force upon the movable platform 106. A first switch 119 is connected to the movable platform 106, wherein the first switch 119 has an engaged position and a disengaged position.

Figure 11:
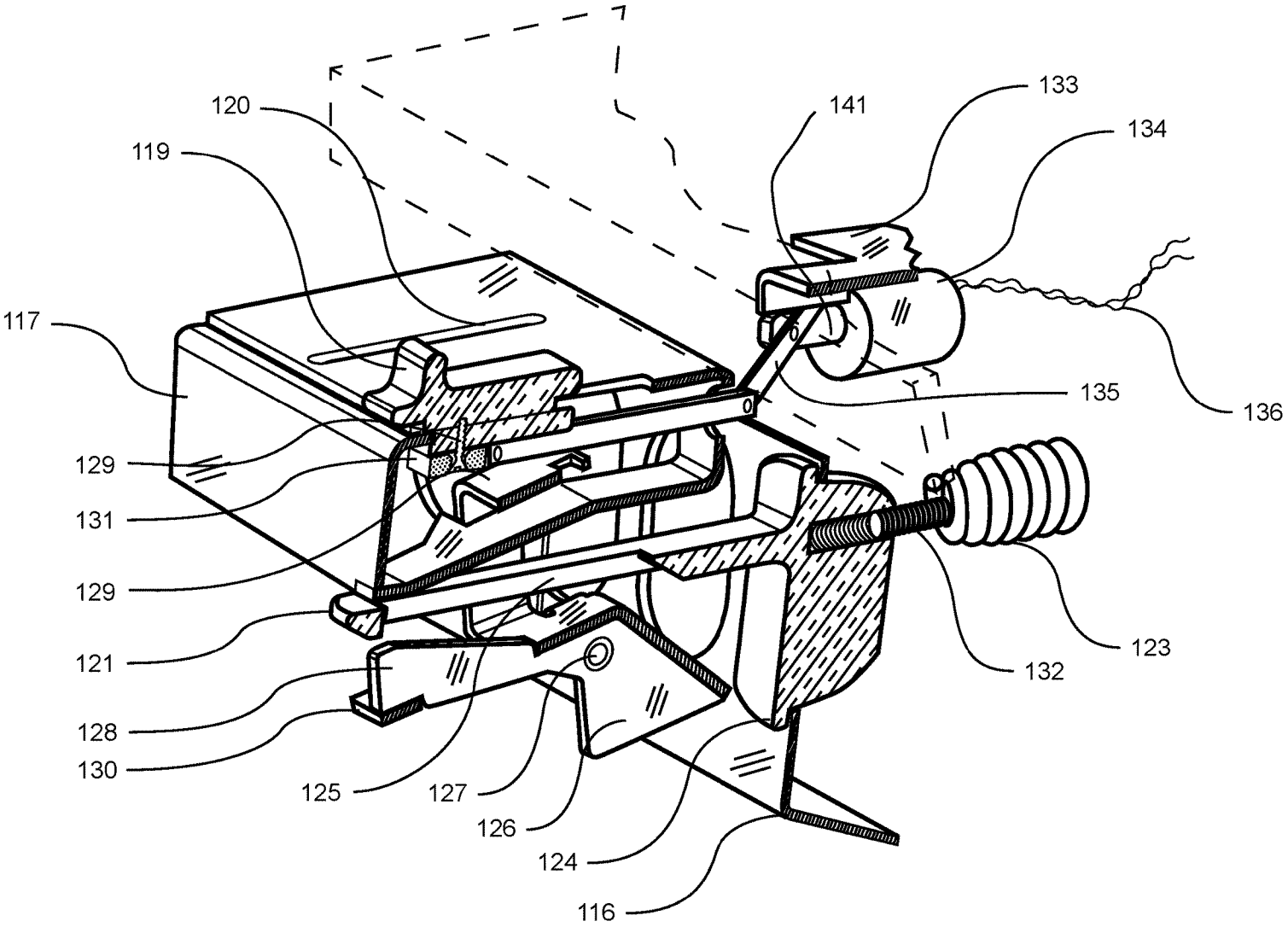
FIG. 11 is an exemplary diagram showing a sectional isometric view of a resistance selector switch operable by a linear actuator in the disengaged position in accordance with an example embodiment.
Figure 12:
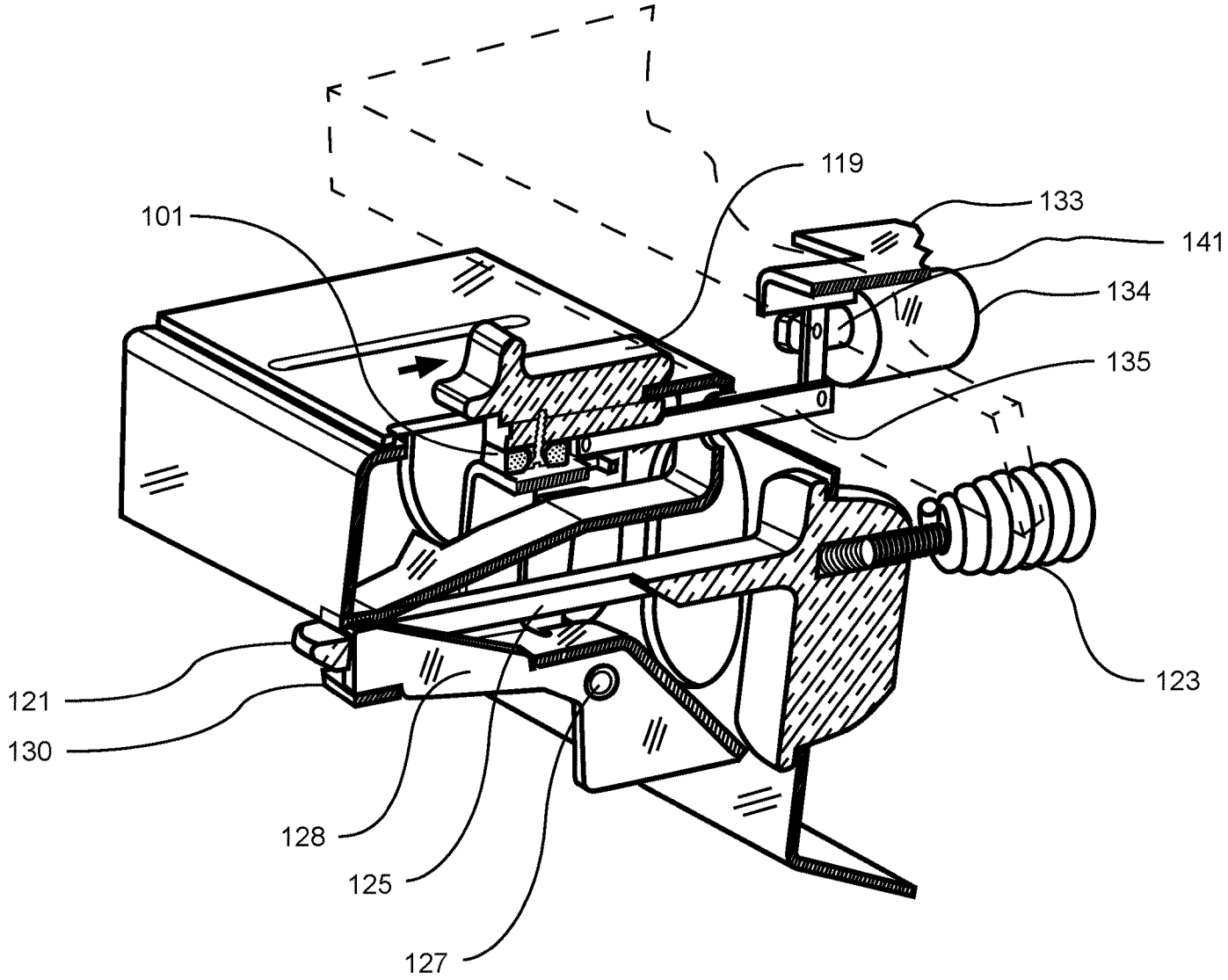
FIG. 12 is an exemplary diagram showing a sectional isometric view of a resistance selector switch in the engaged position, operable by a linear actuator in accordance with an example embodiment.

As shown in FIGS. 11 and 12, a first latch 126 is adapted to be selectively connectable to the first bias member 115, wherein the first latch 126 has an engaged position and a disengaged position, wherein the first latch 126 is adapted to be manipulated by the first switch 119 into the engaged position or the disengaged position, wherein the first latch 126 is connected to the first bias member 115 so as to apply the resistance force upon the movable platform 106 when the first latch 126 is in the engaged position, and wherein the first latch 126 is not connected to the first bias member 115 when the first latch 126 is in the disengaged position.

Figure 15:
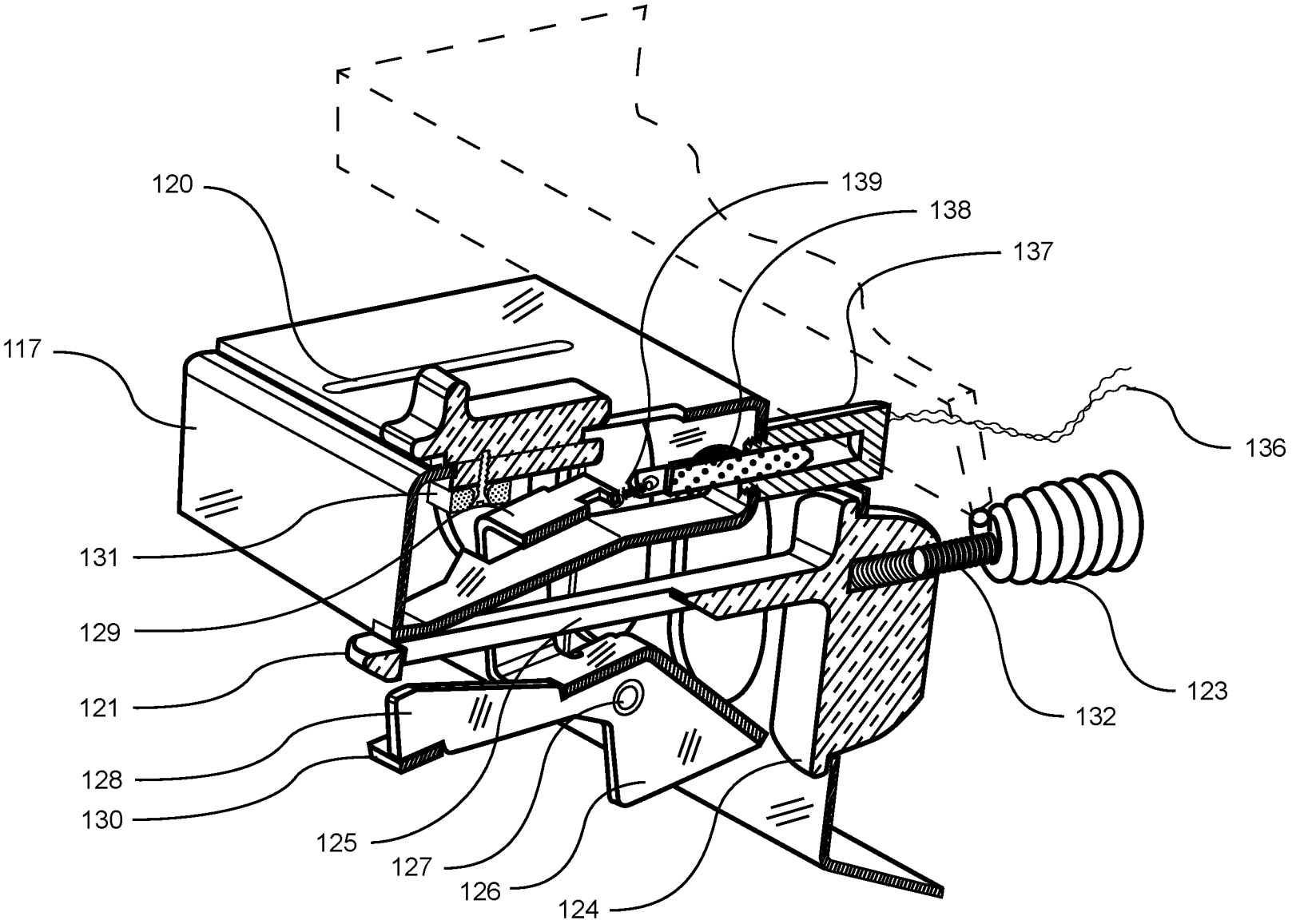
FIG. 15 is an exemplary diagram showing a sectional isometric view of a resistance selector switch in the disengaged position, operable by an electrical solenoid in accordance with an example embodiment.
Figure 16:
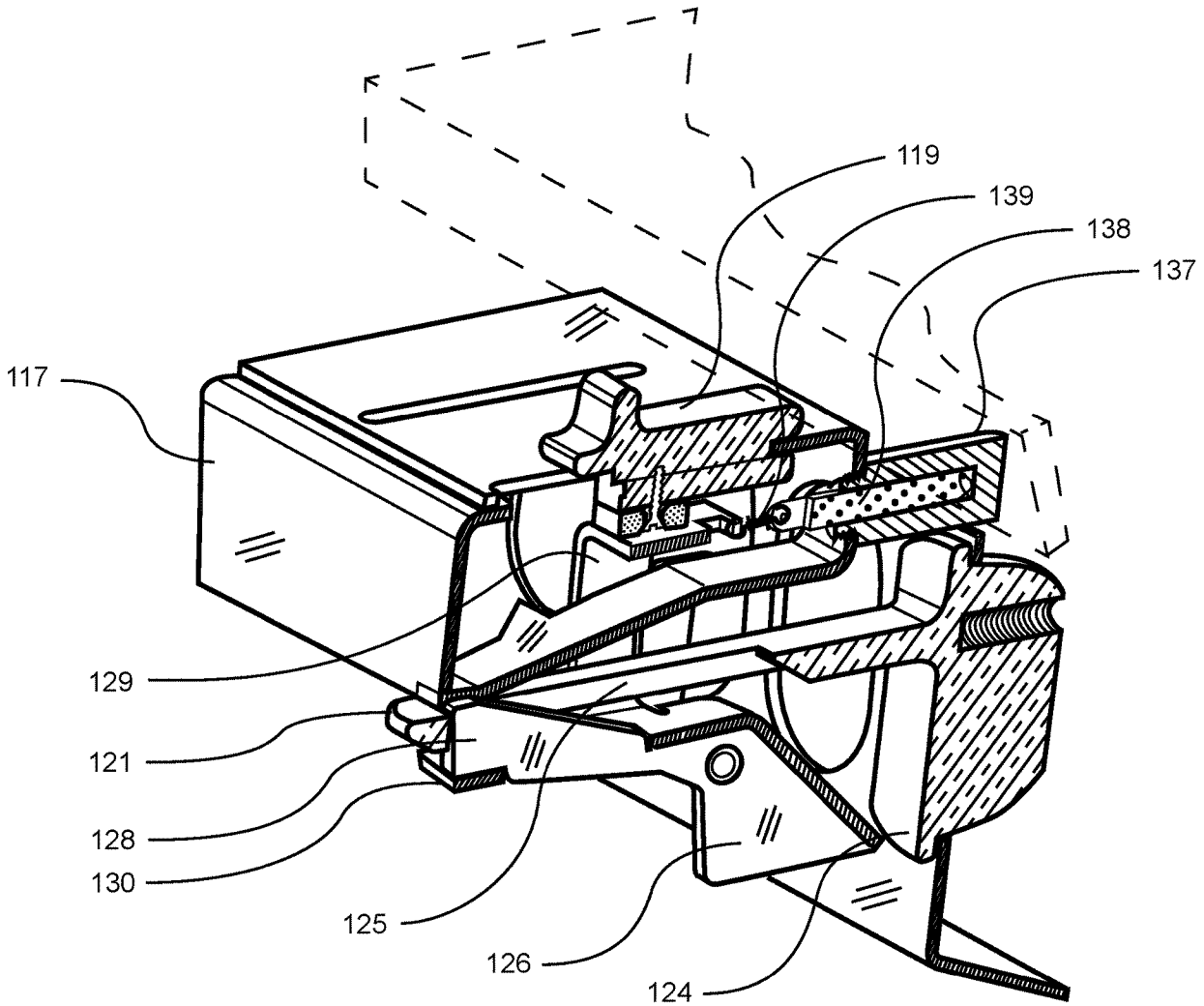
FIG. 16 is an exemplary diagram showing a sectional isometric view of a resistance selector switch in the engaged position, operable by an electrical solenoid in accordance with an example embodiment.

As shown in FIGS. 15 and 16, the first switch 119 may be slidable between the engaged position and the disengaged position. The first latch 126 may be adapted to pivot between the engaged position and the disengaged position. The first switch 119 may comprise a magnet 131, wherein the magnet 131 of the first switch 119 is adapted to magnetically attract the first latch 126 when the first switch 119 is in the engaged position. The first bias member 115 may be comprised of a spring. A docking station 116 may be connected to the exercise machine 100, wherein the docking station 116 includes an opening for receiving the first bias member 115, wherein the first bias member 115 is connected to the docking station 116 when the first bias member 115 is not connected to the movable platform 106.

Figure 19:
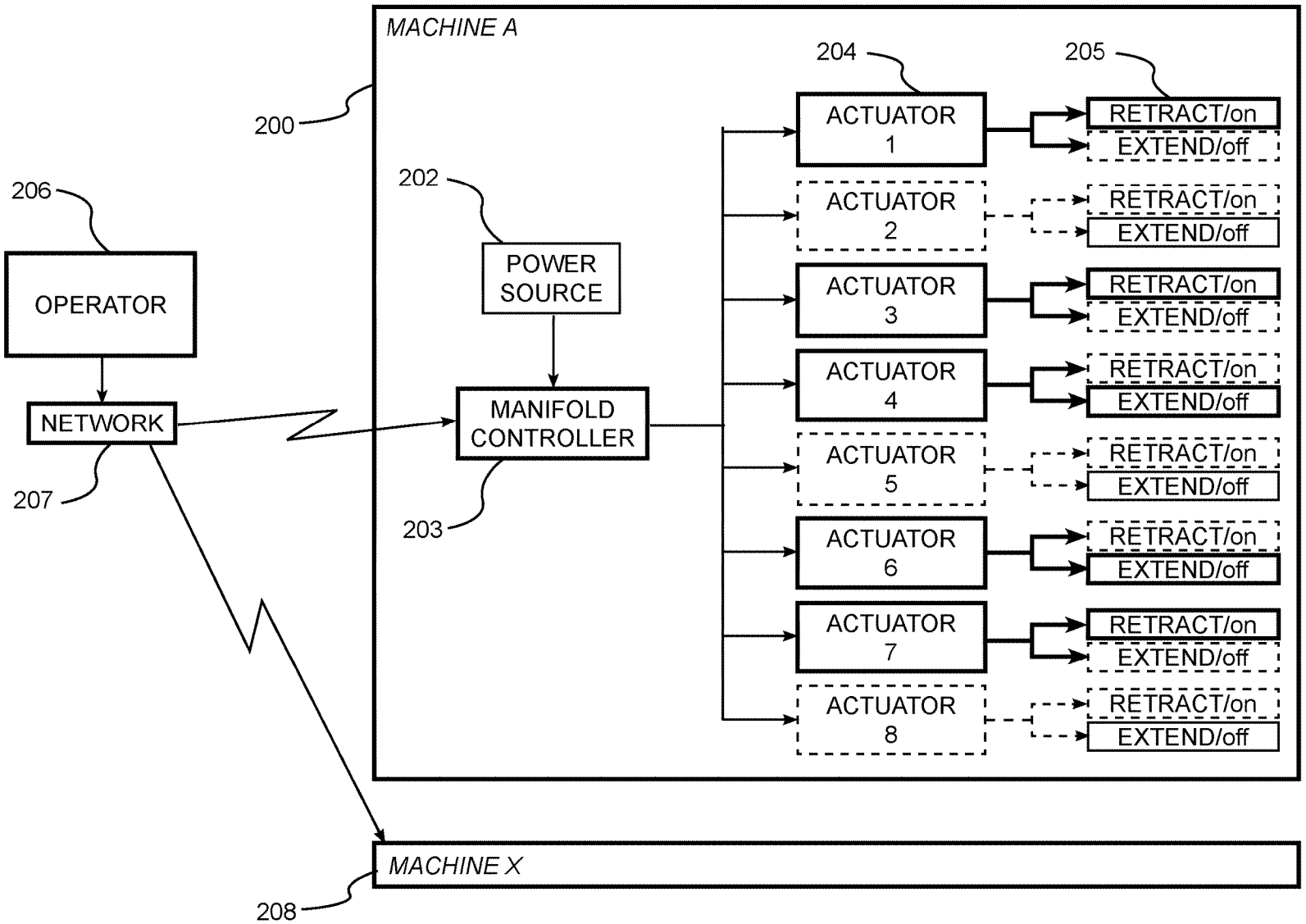
FIG. 19 is an exemplary illustration showing the controller block diagram of an improved exercise machine in accordance with an example embodiment.

As shown in FIGS. 11, 12, and 19, a first actuator 134 may be connected to the first switch 119, wherein the first actuator 134 is adapted to adjust the first switch 119 between the engaged position and the disengaged position. The first actuator 134 may be comprised of a solenoid 137. A remote control 206 may be used for controlling the first actuator.

As shown in FIG. 20, the exercise machine 100 may further comprise a second bias member 115 selectively connectable to the movable platform 106 and a second switch 119 having an engaged position and a disengaged position, wherein the second switch 119 is connected to the movable platform 106. A second latch 126 having an engaged position and a disengaged position is adapted to be manipulated by the second switch 119 into the engaged position or the disengaged position, wherein the second latch 126 is connected to the second bias member 115 when the second latch 126 is in the engaged position, wherein the second latch 126 is not connected to the second bias member 115 when the second latch 126 is in the disengaged position. The first switch 119 may be parallel with respect to the second switch 119. The exercise machine 100 may also include a cassette manifold 110 connected to the movable platform 106, wherein the first switch 119 and the second switch 119 are connected to the cassette manifold 110.

A first actuator 134 may be connected to the first switch 119 and a second actuator 134 may be connected to the second switch 119, wherein the first actuator 134 is adapted to adjust the first switch 119 between the engaged position and the disengaged position, wherein the second actuator 134 is adapted to adjust the second switch 119 between the engaged position and the disengaged position. The first and second switches 119 may be manually adjustable. The first and the second actuator 134 may each be comprised of a solenoid 137. A remote control 206 may be used for controlling the first and the second actuator 134. The second switch 119 may be comprised of a magnet, wherein the magnet of the second switch 119 is adapted to magnetically attract the second latch 126 when the second switch 119 is in the engaged position. The second latch 126 may be adapted to pivot between the engaged position and the disengaged position.

As shown in FIGS. 9 and 10, a docking station 116 may be connected to the exercise machine 100, wherein the docking station 116 comprises openings for receiving the first bias member 115 and the second bias member 115, wherein the first bias member 115 is connected to the docking station 116 when the first bias member 115 is not connected to the movable platform 106, wherein the second bias member 115 is connected to the docking station 116 when the second bias member 115 is not connected to the movable platform 106.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

The phrase "linear actuator" is used herein to mean a device used to create linear motion by moving an extendible/retractable piston or shaft portion of an actuator relative to a stationary body of the actuator. The type of linear actuators used on the present invention described below is not intended to be limiting, and may comprise one or more types of linear actuators well known to those skilled in the art including, but not limited to mechanical, pneumatic, hydraulic, or electromechanical actuators.

The phrase "bias member" as used herein to mean a device used to apply a resistance force to a moveable platform of an exercise machine. The type of biasing member used on the present invention may in some embodiments comprise one or more extension springs, but may also comprise in other embodiments one or more of multiple types of biasing member well known to those skilled in the art including, but not limited to any elongated member capable of providing resistance, including but not limited to extension springs or elastic ropes that are removably attachable at one end to an exercise platform that moves reciprocally on and parallel to longitudinal guide rails, with the opposed end of the bias member affixed to a stationary member of the exercise machine.

Although more than one embodiment is illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

B. Exercise Machine with Resistance Selector System.

FIG. 1 illustrates an exemplary embodiment an improved exercise machine 100 comprising a substantially longitudinal structure supported on a floor by a plurality of vertical support members 101 and integral anti-skid feet 102. An upper structure may comprise a pair of sliding rails 107 extending substantially the length of the machine 100 between a front exercise stationary platform 104 and a back stationary exercise platform 105. One or more front handle assemblies 108 may be affixed proximate to the front exercise stationary platform 104, and one or more rear handle assemblies 109 may be affixed proximate to the rear exercise stationary platform 105. A reciprocating exercise platform 106 may slide on one or more sliding rails 107 substantially between the front exercise platform 104 and rear exercise platform 105, such as parallel sliding rails 107 as shown in the figures, by various methods, such as but not limited to use of wheels (not shown).

A cassette manifold 110 may be affixed to the reciprocating platform 106 to provide for the attachment and detachment of one end of a plurality of bias members 115, with the opposed ends of the bias members 115 being affixed to the stationary machine 100 structure. When one or more of the bias members 115 are attached to the cassette manifold 110, they may exert a resistance force upon the reciprocating platform 106. In practice, an exerciser 300 desiring to slide the reciprocating platform 106 during exercise must exert a force upon the reciprocating platform 106 in a direction opposed to and greater than the resistance force created by the one or more bias members 115.

Figure 2A:
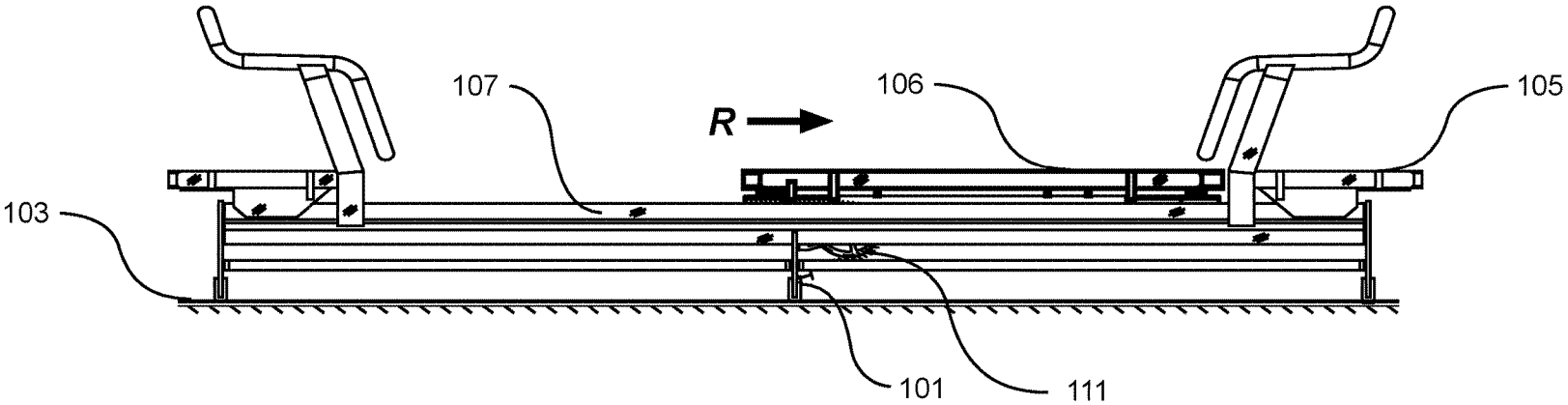
FIG. 2A is an exemplary diagram showing a side view of an improved exercise machine in accordance with an example embodiment.

FIG. 2A is an exemplary diagram showing a side view of an exemplary embodiment of an improved exercise machine 100 comprising a frame such as a substantially longitudinal structure supported from a floor 103 by a plurality of vertical support members 101. An upper structure may comprise a one or more sliding rails 107 extending substantially the length of the machine 100 between a front exercise platform 104, a rear exercise platform 105, and handle assemblies 108, 109 as previously described. One or more bias members 115 may be attached at one end to the cassette manifold 110, with a second end affixed to a resistance biasing assembly 111, thereby creating a substantially longitudinal resistance force against the reciprocating platform 106 represented by "R" in a direction towards the rear exercise platform 105 as indicated by the arrow.

Figure 2B:
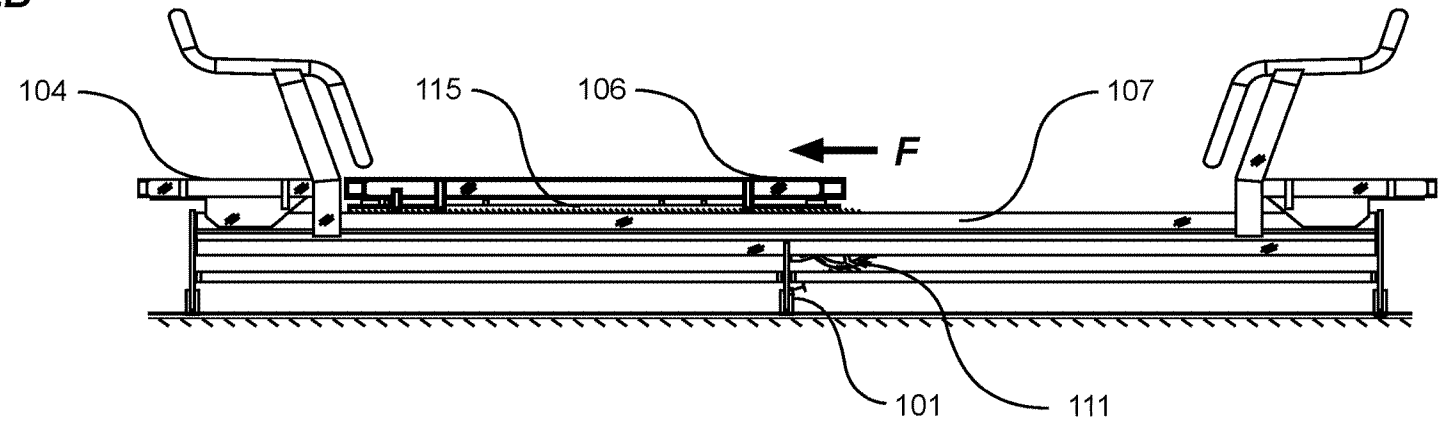
FIG. 2B is an exemplary diagram showing an alternate side view of an improved exercise machine in accordance with an example embodiment.

FIG. 2B illustrates an exemplary exercise machine 100 comprising a substantially longitudinal structure supported from a floor 103 by a plurality of vertical support members 101. An upper structure may comprise a pair or sliding rails 107 which extend substantially the length of the machine 100 between a front exercise platform 104, a rear exercise platform 105, and handle assemblies 108, 109 as previously described. One or more bias members 115 may be attached at one end to the cassette manifold 110, with a second end affixed to a resistance biasing assembly 111, thereby creating a resistance force that has been overcome by a force applied to the reciprocating exercise platform 106 by an exerciser 300 in a direction as indicated by the arrow towards a front exercise platform 104, the exercise force to overcome the exercise force represented in the drawing by "F". In other words, "F">"R" of FIG. 2A. As can be readily seen, the one or more bias members 115 are shown extended as the reciprocating platform is moved in a direction towards the front exercise platform 104.

Figure 3A:
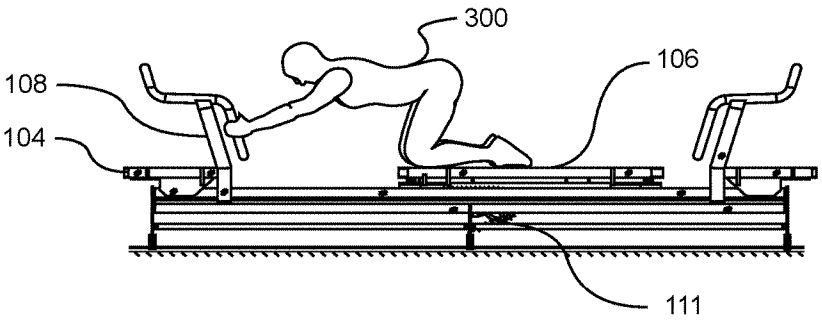
FIG. 3A is an exemplary diagram showing a side view of an improved exercise machine with an exerciser positioned to perform an exercise in accordance with an example embodiment.

FIG. 3A is an exemplary diagram showing a side view of an exemplary exercise machine 100 with an exerciser 300 in a kneeling position upon a reciprocating platform 106 performing exercises, with the hands grasping one or more front handle assemblies 108 proximate to the front exercise platform 104. In order to move the reciprocating platform 106 towards the front exercise platform 104, the exerciser 300 must engage muscles that would effectively pull the reciprocating platform 106 to increase the length of the one or more bias members 115 between the cassette manifold 110, and the resistance biasing assembly 111.

One exercise cycle is considered to be the movement by the exerciser 300 of the reciprocating exercise platform 106 from a starting position at which point no spring forces act upon the reciprocating platform 106, the work portion of the cycle during which the exerciser 300 moves the reciprocating platform 106 in a direction that continually lengthens all of the engaged springs until the exerciser 300 stops, and allows the springs to retract the reciprocating exercise platform 106 back to the starting position.

Figure 3B:
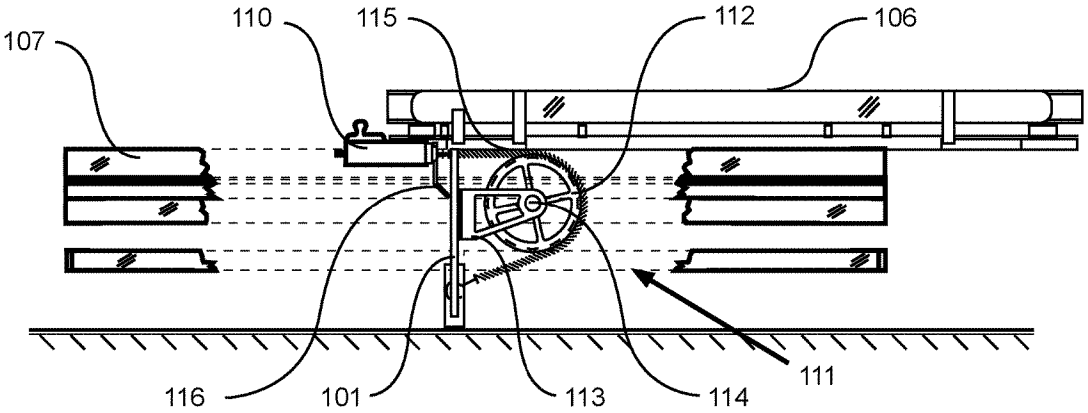
FIG. 3B is an exemplary diagram showing a side view of a resistance biasing assembly of an improved exercise machine with a portion of the structure cut away to reveal a resistance basing assembly in accordance with an example embodiment.

FIG. 3B is an exemplary diagram showing a side view of an exemplary embodiment of an exercise machine 100 with a portion of the machine structure cut away to reveal a resistance biasing assembly 111. As shown in FIG. 3B, a reciprocating exercise platform 106 may be positioned on one or more longitudinal rails 107, the exercise platform 106 comprising a cassette manifold 110 affixed to the reciprocating platform 106 at a front end thereof. A resistance biasing assembly 111 comprises a pulley yoke 113 affixed to a stationary machine vertical support member 101, a pulley wheel 112 rotatably affixed to the pulley yoke by use of a pulley axle 114, and a bias member 115. A first end of the bias member is affixed to the stationary vertical support member 101, the bias member therefrom wrapping about the pulley wheel 112 and terminating at a docking station 116 that is affixed to a stationary structure.

Although the side view illustrates a single resistance biasing assembly 111, it is preferred that the exercise machine provides for two or more resistance biasing assemblies 111.

Figure 3C:
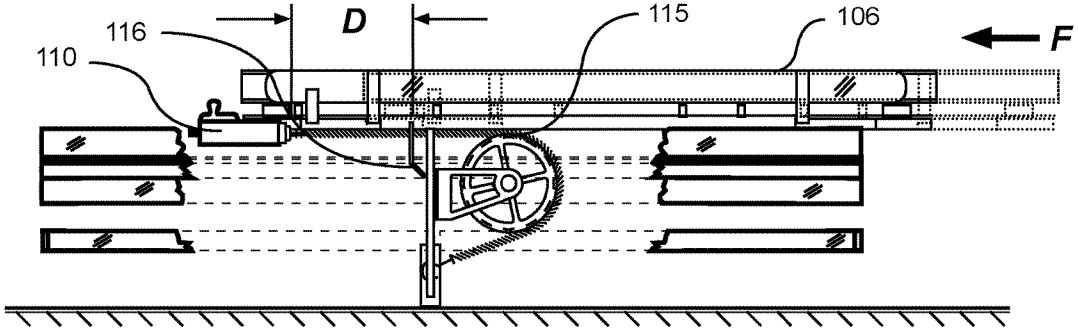
FIG. 3C is an exemplary diagram showing an alternate side view of a resistance biasing assembly of an improved exercise machine with a portion of the structure cut away to reveal a resistance basing assembly in accordance with an example embodiment.

FIG. 3C is an exemplary diagram showing an alternate side view of an exemplary embodiment of a resistance biasing assembly 111 of an exemplary exercise machine 100; with a portion of the exercise machine 100 structure cut away to reveal the resistance basing assembly 111. As shown in FIG. 3C, the reciprocating exercise platform 106 is illustrated as having been slid along the rails 107 from its origination position as indicated by the dotted platform outline in response to a force "F" in the direction indicated by the arrow. As can be seen in the drawing, the cassette manifold 110, together with the reciprocating exercise platform 106 to which it is attached have moved as one assembly an equal distance "D" in a direction distal to the docking station 116. The bias member 115, with a first end removably attached to the cassette manifold 110, has increased in length the same distance "D', thereby exerting a variable resistance opposed to the exerciser 300 exerted force "F".

Figure 4:
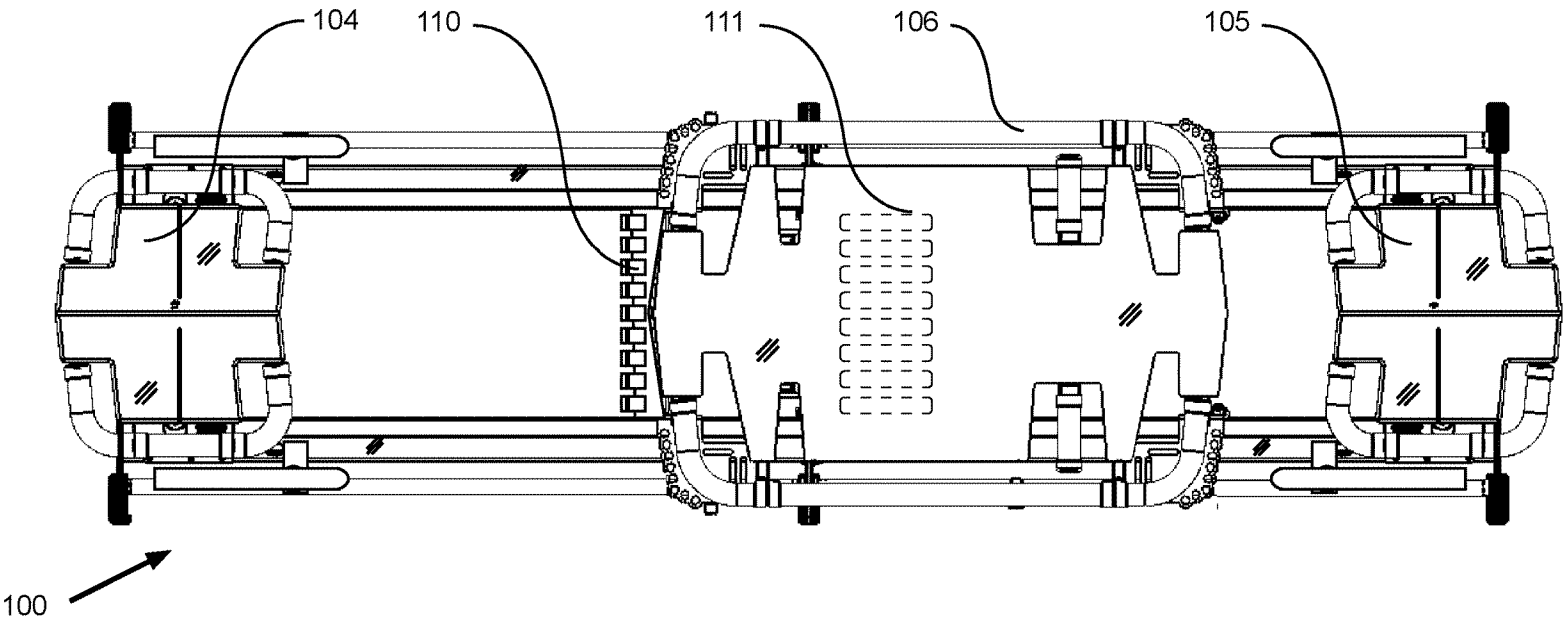
FIG. 4 is an exemplary diagram showing an top view of an improved exercise machine in accordance with an example embodiment.

FIG. 4 is an exemplary diagram showing an exemplary embodiment of a top view of an improved exercise machine 100 comprising a stationary front exercise platform 104 and stationary rear exercise platform 105. Also shown is a cassette manifold 110 affixed to a reciprocating exercise platform 106 as previously described. A plurality of resistance biasing assemblies 111 as just described in FIGS. 3A, 3B, 3C is shown as a plurality of dotted lines representing their approximate locations on the underside of the reciprocating platform 106, and may comprise eight separate biasing assemblies 111 as shown; however any number (more or less) of biasing assemblies 111 may be used.

It should be noted that in place of, or used together with the plurality of biasing assemblies 111 as just described, simple springs and/or elastic cables may be used. When simple springs and/or elastic cables are used, a first end would be preferably retained by the docking station 116 and a second end would be affixed to a distal stationary member of the exercise machine 100 structure.

Figure 5:
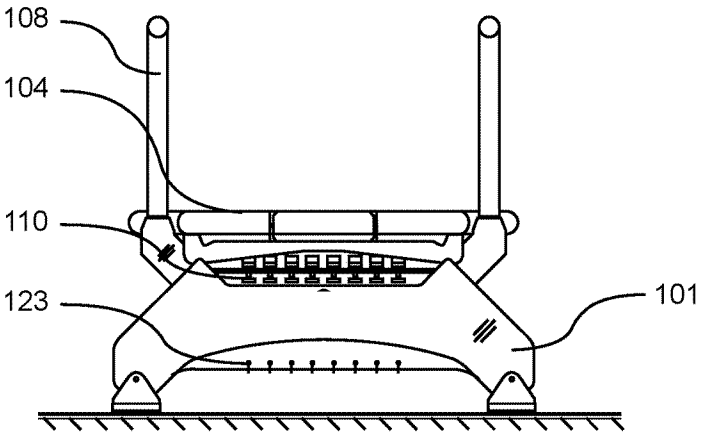
FIG. 5 is an exemplary diagram showing an end view of an improved exercise machine in accordance with an example embodiment.

FIG. 5 is an exemplary diagram showing a front end view of an exemplary embodiment of an exercise machine 100 comprising a front exercise platform 104, a pair of front end handles assemblies 108 with the handles assemblies on the left and right sides of the machine preferably being substantially mirror images of each other, and a portion of a cassette manifold 110 being seen beyond the proximal left end vertical support member 101. Further, as can be seen, the stationary ends of a plurality of springs 123 are shown affixed to a stationary member beyond the proximal left end vertical support member 101.

Figure 6:
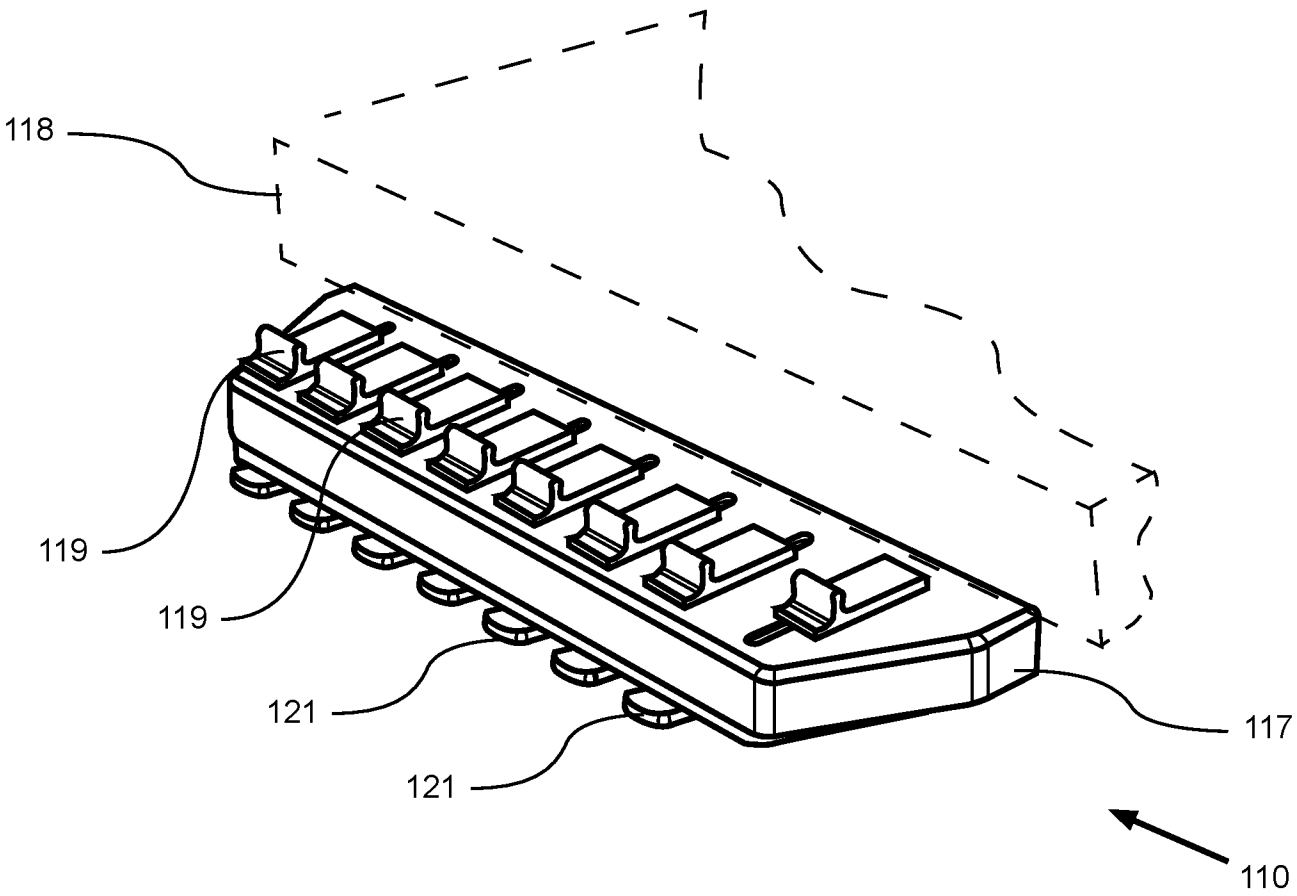
FIG. 6 is an exemplary diagram showing an isometric view of a resistance selector switch cassette manifold in accordance with an example embodiment.

FIG. 6 is an exemplary diagram showing an isometric view of an exemplary embodiment of a resistance selector switch cassette manifold 110 affixed to the reciprocating platform structure 106, shown as a dashed line so as not to obscure the cassette manifold 110. The cassette manifold structure 117 may comprise a plurality of slide switches 119, the number of slide switches 119 preferably being the same as the number of resistance bias members 115 attached to the exercise machine 100. In practice, the movement of the slide switches 119 would engage or disengage each respective pull socket 121 as will be described below in more detail.

As has been discussed, the cassette manifold 110 may be attached to a resistance exercise machine 100, and provides for an improved method of changing the desired exercise resistance exerted upon the reciprocating exercise platform 106 of the exercise machine 100.

The resistance selection slide switches 119 described herein introduce a method of increasing or decreasing the exercise resistance exerted upon a reciprocating exercise platform 106 by engaging one or more slide switches 119 by either manually manipulating each switch 119, and/or by manipulating each switch 119 remotely (such as by a mobile device or remote control). An exemplary embodiment of the device as will be described herein provides for the overriding of any switch state by manual manipulation, for remotely overriding any manually selected switch state, and for manually overriding any remotely selected switch state.

Yet another preferred embodiment of the device provides for the safety of engaging or disengaging each of the resistance bias members 115 only when the reciprocating platform 106 is in a stopped position at the bottom, or starting point of the reciprocation cycle, as will be described in detail. The introduction of this function provides for the safety of the exerciser 300 mounted on the reciprocating platform 106 by preventing any sudden increase or decrease in the resistance biasing force upon the reciprocating platform 106 while the exerciser 300 is in the middle of an exercise reciprocation.

It should be noted that the following FIG. 7-FIG. 18 show only a single slide switch 119 of the plurality of slide switches 119 of the assembly to simplify the illustration and description of the slide switch 119 details of the cassette manifold 110 assembly. However, the following description would be substantially the same for each of the plurality of slide switches 119. Further, in FIG. 7-FIG. 16, the reciprocating platform structure 118 is shown as a dashed line for topographical reference.

Figure 7:
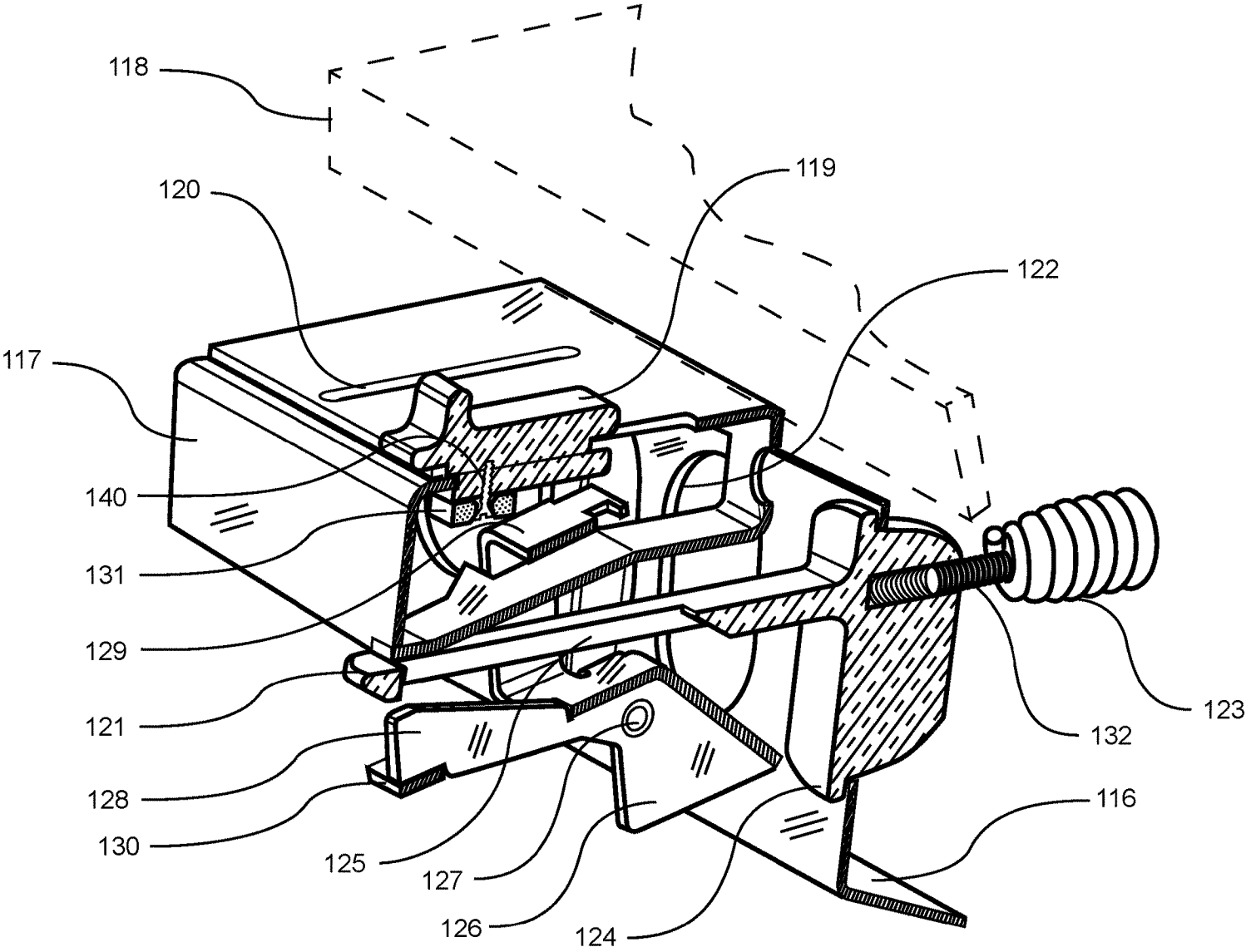
FIG. 7 is an exemplary diagram showing a sectional isometric view of a manual resistance selector switch in the disengaged position in accordance with an example embodiment.

FIG. 7 is an exemplary diagram showing a sectional isometric view of an exemplary embodiment of a manual resistance selector switch in the disengaged position. The hatched lines indicate sectional views through a slide switch 119, cassette manifold structure 117, zero force latch 126, pull socket 121, and docking station 116. For clarity, the spring 123 and spring fastener 132 are shown in a non-sectional isometric view.

Continuing to reference FIG. 7, a slide switch 119 may be mounted through the switch retainer slot 120 of the manifold structure 117. This is preferably accomplished by installing an upper and lower portion of the slide switch 119 respectively proximate to the upper and lower surface of the manifold structure 117 material through which the slot 120 is positioned; the upper and lower portion of the switch 119 being removably secured together by a fastener 140. The fastener 140 may further secure a permanent switch magnet 131 to the underside of the slide switch 119.

The pull socket 121 may provide for a socket strike 125 slot through which a latch bolt 128 may enter. As shown in FIG. 7, the latch bolt 128 is shown lowered and not positioned within the socket strike 125. Further, a portion of a docking station 116 provides for a plurality of openings such as socket berths 122 into which each of a plurality of socket flanged hubs 124 of each respective pull socket 121 are located, the socket flanged hubs 124 being retained within the socket berths 122 of the docking station 116 by the nominal biasing of an extension spring 123 that is affixed to the distal portion of the socket flanged hub 124 by a spring fastener 132.

A zero force latch 126 may be rotatable relative to the manifold structure 117 about a latch pivot axle 127 affixed to the manifold structure 117. The zero force latch 126 may comprise a latch dead weight 130 affixed to substantially the proximate portion of the latch bolt 128, and a ferromagnetic latch handle 129 extending upwardly from the latch 126 towards the proximity of the permanent switch magnet 131. The default position of the zero force latch 126 is shown with the proximate latch bolt 128 lowered relative to a pull socket 121 having rotated in a counterclockwise direction about the latch pivot axle 127 in response to the gravitational force acting on the latch dead weight 130. The default state of the switch position just described is referred to herein as the disengaged position.

Figure 8:
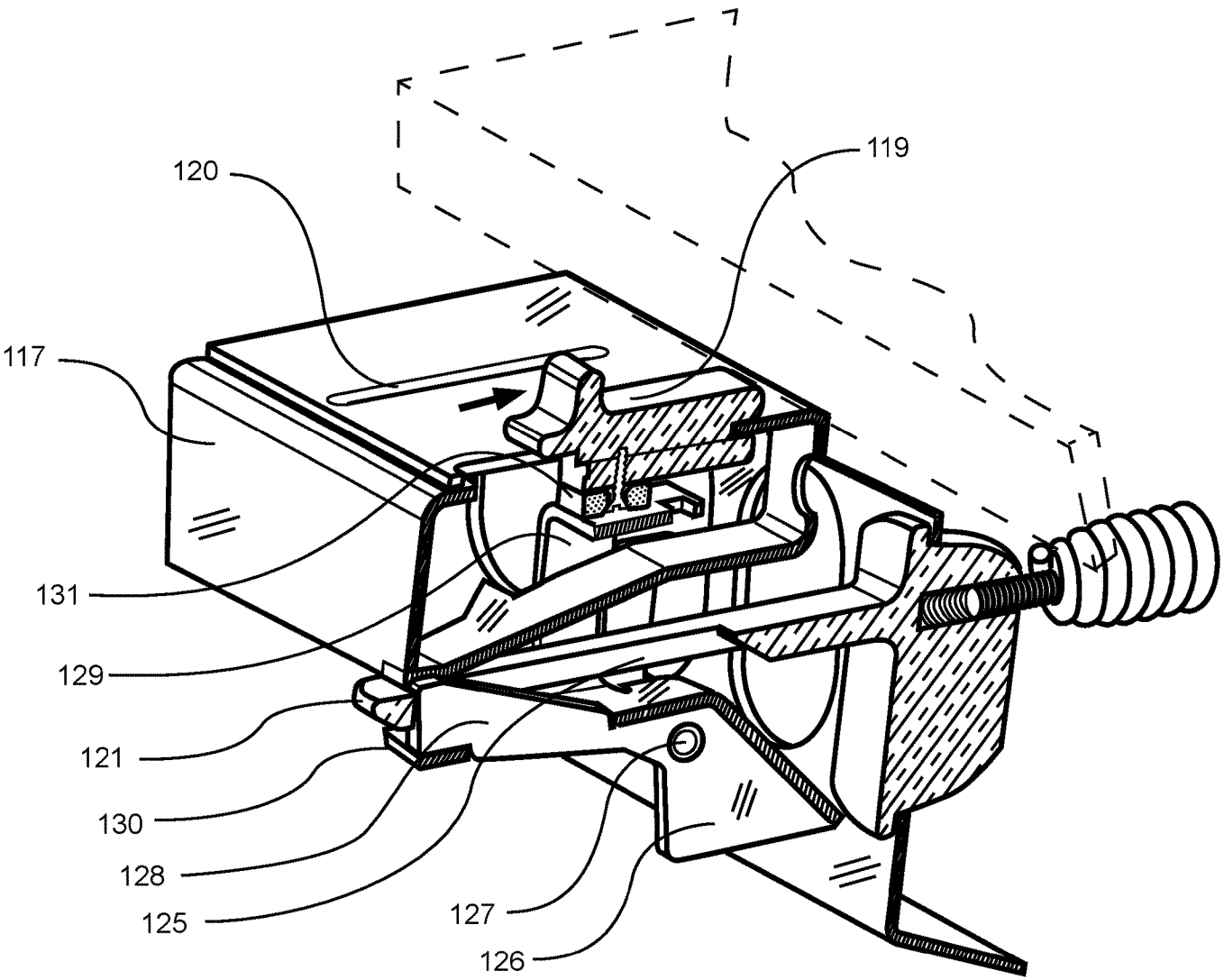
FIG. 8 is an exemplary diagram showing a sectional isometric view of a manual resistance selector switch in the engaged position in accordance with an example embodiment.

FIG. 8 is an exemplary diagram showing a sectional isometric view of an exemplary embodiment of a manual resistance selector switch in the engaged position. The hatched lines indicate sectional views through a slide switch 119, cassette manifold structure 117, zero force latch 126, pull socket 121, and docking station 116.

As shown in FIG. 8, a slide switch 119, having been mounted through the switch retainer slot 120 of the manifold structure 117, may be manually slid backward by an exerciser 300 in the direction towards the reciprocating platform 106 as indicated by the arrow. This sliding direction of the switch correspondingly moves the switch magnet 131 affixed to the underside of the switch 119 proximate to the ferromagnetic materials of the latch handle 129, the magnetic attraction between the magnet 131 and latch handle 129 thereby causing the latch handle 129 to attract towards the magnet. The force of the magnetic attraction between the switch magnet 131 and latch handle 129 as just described exceeds the gravitational force exerted on the latch dead weight 128, and causes the latch 126 to rotate in a clockwise manner about the latch pivot axle 127. As can be readily seen, then the latch 126 is rotated clockwise as just described; the latch bolt 128 portion of the latch has moved in an upward direction, entering into the socket strike 125 of the pull socket 121.

The state of the slide switch 119 wherein the latch bolt 128 is positioned within the socket strike slot 125 may be considered an engaged switch position.

FIG. 9 is an exemplary diagram showing a sectional isometric view of an exemplary embodiment of a manual resistance selector switch in the disengaged position in operation. As shown in FIG. 9, a cassette manifold 110 may comprise a manifold structure 117, a slide switch 119, and a zero force latch 126. The latch 126 is shown in the disengaged state with a latch dead weight 130 having rotated the latch bolt 128 counterclockwise about the latch pivot axle 127. A slide switch 119 is shown in the forward position as described in FIG. 7. The manifold structure 117 may be attached to the reciprocating platform 106 structure as previously described. As the exerciser 300 pushes the reciprocating exercise platform 106 in a direction indicated by the arrow, the reciprocating platform 106 and manifold structure 117 move as a single assembly, thereby increasing the dimension between the manifold structure 117 and the docking station 116 that is affixed to a stationary member of the resistance exercise machine 100. The latch bolt 128, having rotated to a position lower than the socket strike 125 provides for the separation of the latch bolt 128 and strike 125.

As the manifold structure 117 moves in a direction away from the docking station 116, the socket flanged hub 124 may remain undisturbed from its default position seated in the socket berth 122. In practice, the total resistance force acting on the reciprocating exercise platform 106 will not include the resistance force that otherwise would have been provided by the spring 123 affixed to the socket flanged hub 124.

FIG. 10 is an exemplary diagram showing a sectional isometric view of an exemplary embodiment of a manual resistance selector switch in the engaged position in operation. As shown in FIG. 10, a cassette manifold 110 is illustrated as comprising a manifold structure 117, a slide switch 119, and a zero force latch 126.

A slide switch 119 is shown in the rearward position as described in FIG. 8. The manifold structure 117 may be attached to the reciprocating platform 106 structure as previously described. As the exerciser 300 pushes the reciprocating exercise platform 106 in a direction indicated by the arrow, the reciprocating platform 106 and manifold structure 117 may move as a single assembly, thereby increasing the dimension between the manifold structure 117 and the docking station 116 that is affixed to a stationary member of the resistance exercise machine 100.

As can be readily seen, the switch 119 and magnet 131, being in the rearward position, attract the ferromagnetic latch handle 129, rotating the latch 126 clockwise, and correspondingly, rotating the latch bolt 128 in an upward direction into the socket strike 125. The engaged latch bolt 128 and socket strike 125 therefore together as a single assembly.

As the manifold structure 117 moves in a direction away from the docking station 116, the socket flanged hub 124 may be pulled from the socket berth 122 in the same direction and distance towards the front end of the exercise machine 100 as the reciprocating platform 106 structure. In practice, the total resistance force acting on the reciprocating exercise platform 106 will therefore include the resistance force being provided by at least the engaged spring 123.

It should be noted that in the instance when an exerciser 300, during the performance of an exercise subsequent to engaging the latch bolt 128 into the socket strike 125, moves an engaged slide switch 119 to the disengaged position, the spring 123 associated with the slide switch 119 will remain engaged so long as the spring 123 force transferred to the socket strike 125 provides sufficient coupling force between the mating interior surface of the socket strike 125 and the proximate edge of the latch bolt 128 so as to prevent the unintended decoupling of the bolt 128 and strike 125.

FIG. 11 is an exemplary diagram showing a sectional isometric view of an exemplary embodiment of a resistance selector switch in the disengaged position. The resistance selector switch is operable by a linear actuator, and/or may be manipulated manually.

The hatched lines indicate sectional views through a slide switch 119, cassette manifold structure 117, zero force latch 126, pull socket 121, and docking station 116. For clarity, the spring 123 and spring fastener 132 are shown in a non-sectional isometric view.

The linear actuator 134 may comprise at least an actuator body, and a linearly repositionable piston 141, the actuator 134 being responsive to electrical signals communicated through controller wires 136. The linear actuator 134 may operate in at least three modes: electrically actuated extension of the length of the piston 141 to its desired maximum extended travel position, electrically actuated retraction of the piston 141 to the minimum desired travel position, and an idle state. It is preferable that the piston 141 of the actuator 134 may be manually repositioned during the idle state.

Continuing to reference FIG. 11, a slide switch 119 may be mounted through the switch retainer slot 120 of the manifold structure 117 as previously described, the fastener 140 of the switch 119 affixing a permanent switch magnet 131 to the underside of the slide switch 119.

A pull socket 121 may serve as a termination of the movable end of a resistance spring 123. A zero force latch 126 may be rotatable about a latch pivot axle 127 affixed to the manifold structure 117 by various methods. The zero force latch 126 may comprise a latch dead weight 130 affixed to substantially the proximate portion of the latch bolt 128, and a ferromagnetic latch handle 129 extending upwardly from the latch 126 towards the proximity of the permanent switch magnet 131.

The linear actuator 134 may be affixed to the manifold structure 117 by an actuator mounting member 133. An actuator linkage 135 may be pivotably attached between the proximate end of the actuator piston 141 and the proximate attaching eyelet on the underside of the slide switch 119.

The default position of the zero force latch 126 is shown with the proximate latch bolt 128 lowered relative to a pull socket 121 having rotated in a counterclockwise direction about the latch pivot axle 127 in response to the gravitational force on the latch dead weight 130, and/or responsive to the extension of the actuator piston 141. The default state of the switch position just described is referred to herein as the disengaged position.

FIG. 12 is an exemplary diagram showing a sectional isometric view of an exemplary embodiment of a resistance selector switch in the engaged position. The resistance selector switch may be operable by a linear actuator 134, and/or may be manipulated manually.

A pull socket 121 may serve as the termination of the movable end of a resistance spring 123. When a latch bolt 128 portion of the rotatable zero force latch previously described is upwardly moved into the socket strike 125 of the pull socket 121, the pull socket 121, together with the spring 123 fastened to the socket flange hub 124, will move concurrently with and in the same direction as the reciprocating platform structure when moved by an exerciser.

The linear actuator 134 may be affixed to the manifold structure 117 an actuator mounting member 133. An actuator linkage 135 may be pivotably attached between the proximate end of the actuator piston 141 and the proximate attaching eyelet on the underside of the slide switch 119.

The engaged position of the zero force latch 126 is illustrated with the latch bolt 128 having been rotated upwardly in a clockwise direction about the latch pivot axle 127 in response to the retraction of the linear actuator piston 141, and/or in response to manual manipulation of the switch 119 by the exerciser. The state of the switch 119 position just described is referred to herein as the engaged position.

Figure 13:
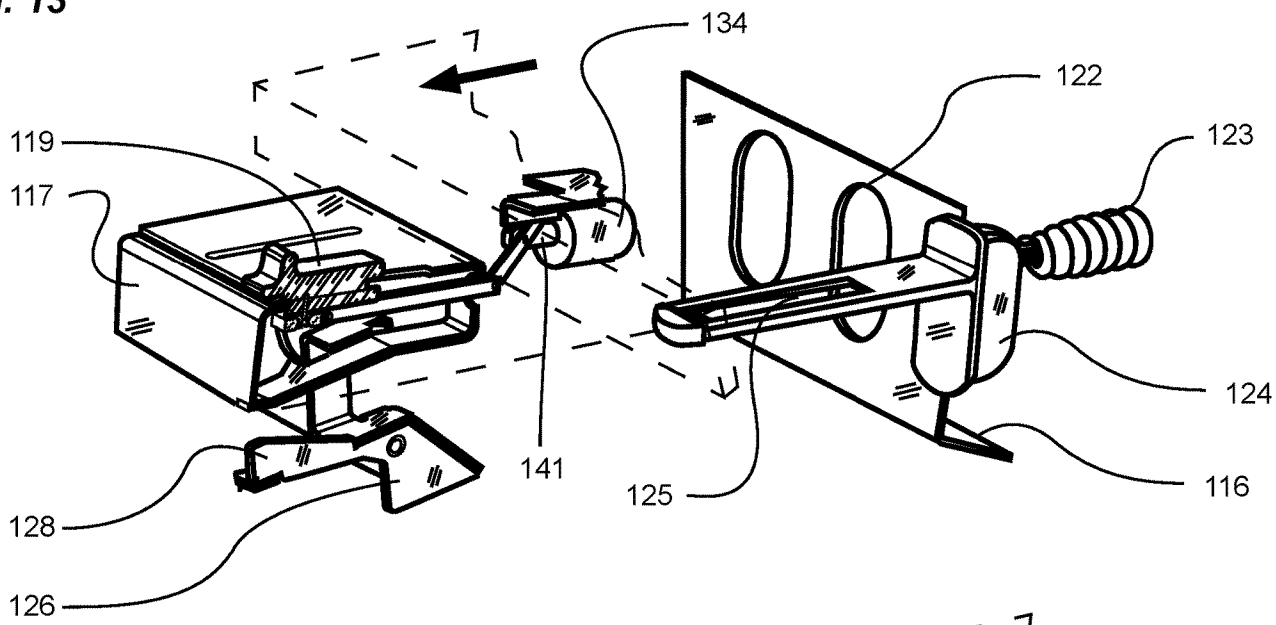
FIG. 13 is an exemplary diagram showing a sectional isometric view of a resistance selector switch in the disengaged position in operation, operable by a linear actuator in accordance with an example embodiment.

FIG. 13 is an exemplary diagram showing a sectional isometric view of an exemplary embodiment of a resistance selector switch 119 operable by a linear actuator 134 in the disengaged position in operation.

As shown in FIG. 13, a cassette manifold 110 may comprise a manifold structure 117, a slide switch 119, and a zero force latch 126. The latch 126 is shown in the disengaged state with the switch magnet 131 exerting a minimal magnetic attraction on the ferromagnetic latch handle 129 as previously described, thereby allowing the latch dead weight 130 to rotate the latch bolt 128 downward in a counterclockwise rotation about the latch pivot axle 127. A slide switch 119 is shown in the forward position.

The manifold structure 117 may be attached to the reciprocating platform 106 structure as previously described. As the exerciser 300 pushes the reciprocating exercise platform 106 in a direction indicated by the arrow, the reciprocating platform 106 and manifold structure 117 may move as a single assembly, thereby increasing the dimension between the manifold structure 117 and the docking station 116 that is affixed to a stationary member of the resistance exercise machine 100. The latch bolt 128, having rotated to a position lower than the socket strike 125, may provide for the separation of the latch bolt 128 and strike 125.

As the manifold structure 117 moves in a direction away from the docking station 116, the socket flanged hub 124 remains undisturbed from its default position seated in the socket berth 122. In practice, the total resistance force acting on the reciprocating exercise platform 106 will not include the resistance force that otherwise would have been provided by the spring 123 affixed to the socket flanged hub 124.

Figure 14:
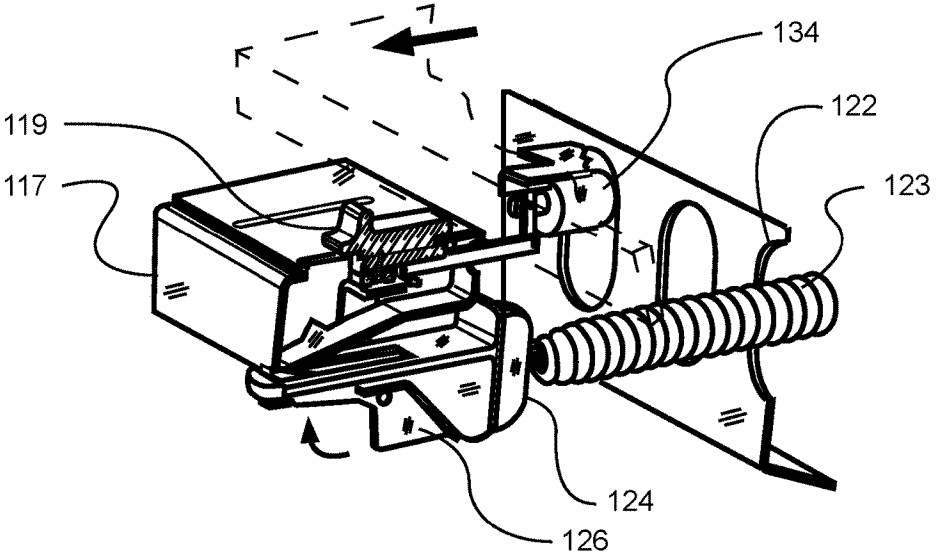
FIG. 14 is an exemplary diagram showing a sectional isometric view of a resistance selector switch in the engaged position in operation, operable by a linear actuator in accordance with an example embodiment.

FIG. 14 is an exemplary diagram showing a sectional isometric view of an exemplary embodiment of a resistance selector switch operable by a linear actuator 134 in the engaged position in operation. In FIG. 14, the cassette manifold 110 is illustrated as comprising a manifold structure 117, a slide switch 119, and a zero force latch 126.

A slide switch 119 is shown in the rearward position as described in FIG. 12. The manifold structure 117 may be attached to the reciprocating platform 106 structure as previously described.

As can be readily seen, the switch 119 and magnet 131, having been slid in the rearward position by retracting the piston 141 of the linear actuator 134, and/or manually sliding the switch 119 in the rearward direction, decreases the distance and increases the magnetic attraction between the ferromagnetic latch handle 129 and switch magnet 131 as previously described, thereby rotating the latch 126 and latch bolt 128 in a clockwise direction. The clockwise rotation of the latch 126 causes the latch bolt 128 to be inserted into the socket strike 125. The latch bolt 128 and socket strike 125 may move together as a single assembly when engaged as just described.

As the manifold structure 117 moves in a direction away from the docking station 116 as indicated by the arrow, the socket flanged hub 124 and resistance spring 123 may be pulled through the socket berth 122 in the same direction and distance as the reciprocating platform 106 structure. In practice, the total resistance force acting on the reciprocating exercise platform 106 will therefore include the resistance force being provided by the spring 123.

It should be noted that in the instance when an exerciser 300 or remote controller moves an engaged slide switch 119 to the disengaged position during the performance of an exercise, the latch bolt 128 may remain engaged into the socket strike 125 until the reciprocating exercise platform 106 returns to and momentarily stops at the default starting position.

FIG. 15 is an exemplary diagram showing a sectional isometric view of an exemplary embodiment of a resistance selector switch operable by a solenoid 137 or by manual manipulation in the disengaged position.

The hatched lines indicate sectional views through a slide switch 119, cassette manifold structure 117, zero force latch 126, pull socket 121, solenoid 137, solenoid piston 138 and docking station 116. For clarity, the spring 123 and spring fastener 132 are shown in a non-sectional isometric view.

The solenoid 137 may comprise at least a solenoid body, and a linearly repositionable piston 138, the solenoid 137 being responsive to electrical signals communicated through controller wires 136. The solenoid 137 may operate in at least two modes: electrically actuated extension of the length of the piston 138 to its desired maximum extended travel position, and electrically actuated retraction of the piston 138 to the minimum desired travel position. The piston 138 of the solenoid 137 may also be manually repositionable when it is not being electrically excited.

Continuing to reference FIG. 15, a slide switch 119 may be mounted through the switch retainer slot 120 of the manifold structure 117 as previously described; the fastener 140 of the switch 119 affixing a permanent switch magnet 131 to the underside of the slide switch 119.

A pull socket 121 may serve as a termination of the movable end of a resistance spring 123. A zero force latch 126 is rotatable about a latch pivot axle 127 as previously described. The zero force latch 126 may comprise a latch dead weight 130 affixed to substantially the proximate portion of the latch bolt 128, and a ferromagnetic latch handle 129 extending upwardly from the latch 126 towards the proximity of the permanent switch magnet 131.

The male threaded portion of a solenoid 137 may be mated to the female threaded portion through a hole in the manifold structure 117; although those skilled in the art will appreciate that any method known for affixing a solenoid 137 to a structural member may be utilized. A piston link 139 may be pivotably attached between the proximate end of the solenoid piston 138 and the attachment structure on the latch handle 129, the method of attachment not shown but may be one of many well-known methods to those skilled in the art.

The default position of the zero force latch 126 is shown with the proximate latch bolt 128 lowered relative to a pull socket 121 having rotated downwardly in a counterclockwise direction about the latch pivot axle 127 in response to the gravitational force on the latch dead weight 130, and/or responsive to the extension of the solenoid piston 138. The default state of the switch position just described is referred to herein as the disengaged position.

FIG. 16 is an exemplary diagram showing a sectional isometric view of an exemplary embodiment of a resistance selector switch 119 operable by manual manipulation, and/or by a solenoid 137 in the engaged position.

A pull socket 121 may serve as a termination of the movable end of a resistance spring 123 when a latch bolt 128 portion of the rotatable zero force latch 126 is upwardly moved into the socket strike 125 of the pull socket 121. The engagement of the latch bolt 128 into the socket strike 125 may provide for the pull socket 121 and the socket flange hub 124 to move concurrently with and in the same direction as the reciprocating platform 106 structure when moved by an exerciser 300.

A solenoid 137 may be affixed to the manifold structure 117 by various methods as previously described. A piston link 139 may be pivotably attached between the proximate end of the solenoid piston 138 and the receiving structure on the latch handle 129.

The engaged position of the zero force latch 126 is shown with the latch bolt 128 having been rotated in a clockwise direction about the latch pivot axle 127 in response to the retraction of the solenoid piston 138, and/or in response to manual manipulation of the switch 119 by the exerciser 300. The state of the switch position just described is referred to herein as the engaged position.

Figure 17:
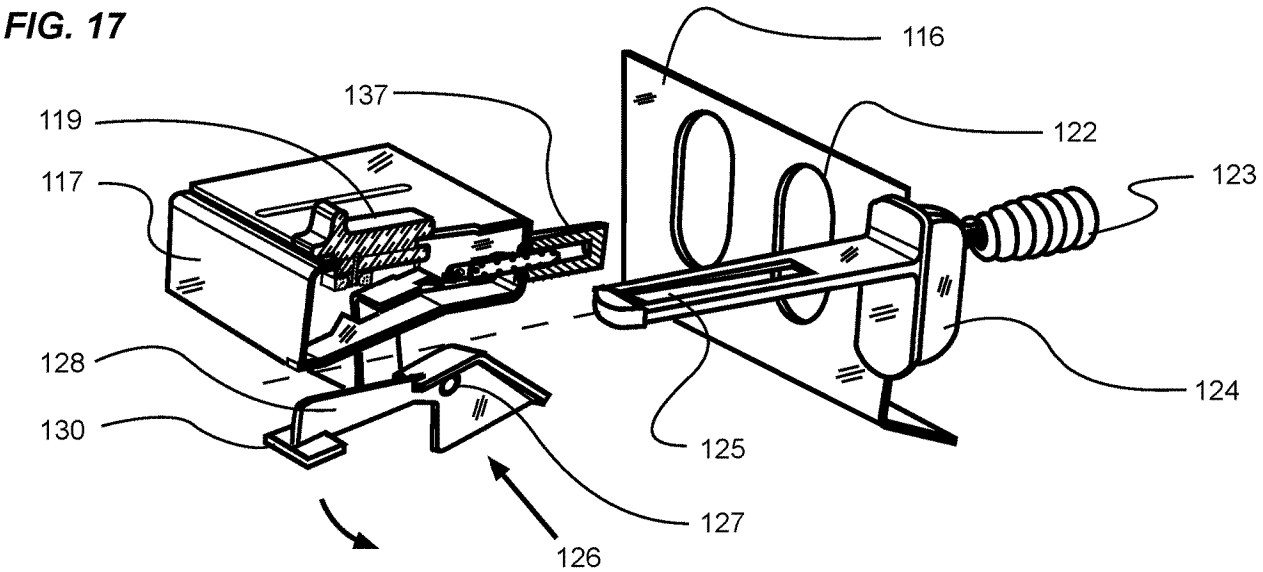
FIG. 17 is an exemplary diagram showing a sectional isometric view of a resistance selector switch in the disengaged position, operable by an electrical solenoid in accordance with an example embodiment.

FIG. 17 is an exemplary diagram showing a sectional isometric view of an exemplary embodiment of a resistance selector switch operable by an electrical solenoid 137 in the disengaged position in operation.

As shown in FIG. 17, a cassette manifold 110 may comprise a manifold structure 117, a slide switch 119, and a zero force latch 126. The latch 126 is shown in the disengaged state with the switch magnet 131 exerting a minimal magnetic attraction towards the ferromagnetic latch handle 129 as previously described, thereby allowing the latch dead weight 130 to rotate the latch bolt 128 counterclockwise about the latch pivot axle 127. A slide switch 119 is shown in the forward position.

The manifold structure 117 may be attached to the reciprocating platform 106 structure. As the exerciser 300 pushes the reciprocating exercise platform 106 as previously described, the reciprocating platform 106 and manifold structure 117 may move as a single assembly, thereby increasing the dimension between the manifold structure 117 and the docking station 116 that is affixed to a stationary member of the resistance exercise machine 100. The latch bolt 128, having rotated to a position lower than the socket strike 125 as indicated by the arched arrow provides for the separation of the latch bolt 128 and socket strike 125.

As the manifold structure 117 moves in a direction away from the docking station 116, the socket flanged hub 124 of the pull socket 121 may remain undisturbed from its default position seated in the socket berth 122. In practice, the total resistance force acting on the reciprocating exercise platform 106 will not include the resistance force that otherwise would have been provided by the spring 123 affixed to the socket flanged hub 124.

Figure 18:
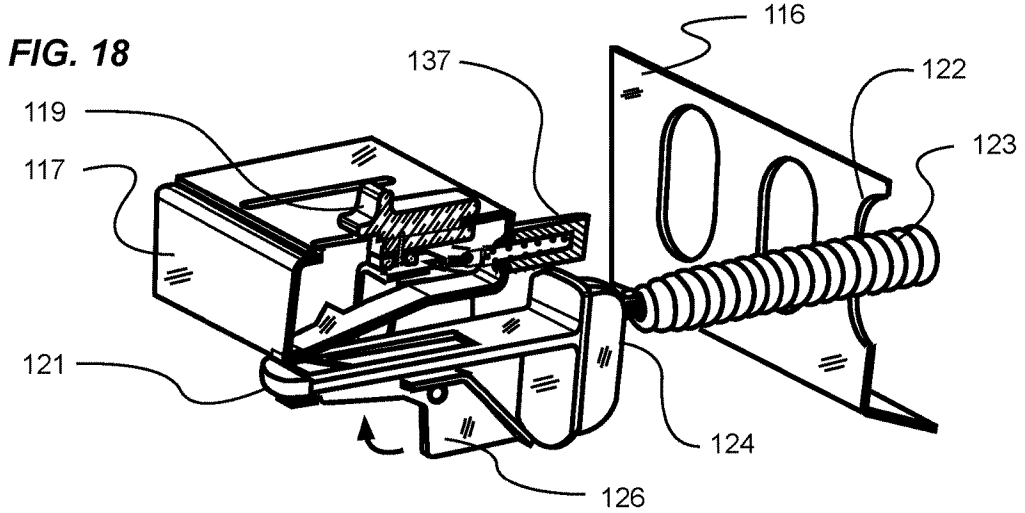
FIG. 18 is an exemplary diagram showing a sectional isometric view of a resistance selector switch in the disengaged position in operation, operable by an electrical solenoid in accordance with an example embodiment.

FIG. 18 is an exemplary diagram showing a sectional isometric view of an exemplary embodiment of a resistance selector switch operable by an electrical solenoid 137 in the disengaged position in operation. As shown, a cassette manifold 110 may comprise a manifold structure 117, a slide switch 119, and a zero force latch 126.

A slide switch 119 is shown in the rearward position as described in FIG. 16. The manifold structure 117 may be attached to the reciprocating platform 106 structure as previously described.

As can be readily seen, the switch 119 and magnet 131, having been slid into the rearward position by retracting the piston 138 of the solenoid 137, and/or manually sliding the switch 119 in the rearward direction, decreases the distance and increases the magnetic attraction between the ferromagnetic latch handle 129 and switch magnet 131 as previously described, thereby rotating the latch 126 and latch bolt 128 in a clockwise direction as indicated by the upward arched arrow. The clockwise rotation of the latch 126 may cause the latch bolt 128 to insert into the socket strike 125. The latched bolt 128 and pull socket 121 may move together as a single assembly when engaged as just described.

As the manifold structure 117 moves in a direction away from the docking station 116, the socket flanged hub 124 and resistance spring 123 may be pulled through the socket berth 122 in the same direction and distance as the reciprocating platform 106 structure. In practice, the total resistance force acting on the reciprocating exercise platform 106 will therefore include the resistance force being provided by the spring 123.

FIG. 19 is an exemplary illustration showing the controller block diagram of an exemplary embodiment of an exercise machine 100. In the drawing, machine "A" 200 and machine "X" 208 are illustrated as comprising the same model machine; thus providing for substantially identical functionality and features. In practice, it is preferable to have a plurality of similar machines so that an exercise class instructor may simultaneously train a plurality of exercisers 300, and remotely control the resistance settings on each and/or all of the plurality of machines 100 being used the class students. The following description of one preferred method of operating machine A 200 will therefore apply to the plurality of machines 100 in an exercise class.

Machine "A" 200 may comprise a power source that will supply the necessary electrical power to operate a wireless controller 203 in communication with a network 207 within an exercise facility. The class instructor may then use a controller operator 206 that is wirelessly connected to the same wireless network as the machine controllers, using well known methods of communicating over a wireless network.

In instances when a wireless network is not available, a wired controller not shown, but in wired communication with the manifold controller 203 may be used. Therefore, the manifold controller 203 may receive various digital and/or analog instructions from the operator 206; the communication comprising at least instructions that manage the operating state of each of a plurality of linear actuators 204, each of the actuators 134 controlling the locking and unlocking of each of the latch bolts 128 to or from their respective socket strikes 125 as previously described. When a control signal is not being sent to an actuator 134, the exerciser 300 may override the locked or unlocked state of the latch bolt 128 by manually sliding any or all slide switches 119 associated with each of the actuators 134.

Continuing to reference FIG. 19, a first actuator 204 is shown having received a signal to retract the piston 205 which, through the attached linkage previously described, pulls the slide switch 119 and, correspondingly the latch handle 129 in a direction toward the actuator 204, thereby engaging the latch bolt 128 into the socket strike 125. Therefore, in the exemplary example, the signal to retract the linear actuator piston 141 couples the reciprocating exercise platform 106 with the resistance spring associated with the first actuator 204.

It should be noted that various other configurations for the actuator linkage may be used whereby the latch bolt 128 will engage with the socket strike 125 when the actuator piston 141 is extended, rather than retracted as just described, and the linkage and piston 141 extension or retraction to engage or disengage the latch bolt 128 is not meant to be limiting.

As can be seen in the illustration, the Actuator 2, Actuator 5 and Actuator 8, shown as dashed lines, signifies that the actuator 204 is in an idle state, having received no signal from the controller. Therefore, the default condition of the latch bolt is that no engagement with the socket strike 125 occurs, the "extended/off" condition therefore shown as a solid line. This is an important safety consideration to ensure that no springs 123 associated with slide switches 119 in the off position are engaged.

Further, when it is preferable to remove the resistance acting upon the reciprocating exercise platform 106 that is associated with any particular spring 123, for instance, the resistance spring associated with Actuator 4 as labelled in FIG. 19, a signal may be sent to the actuator 204 through the manifold controller 203 to extend the actuator piston 141, thereby decoupling the latch bolt 128 from the socket strike 125.

As previously discussed, if the controller 203 may send an "extend/off", or "retract/on" signal to the actuator 204 with the objective of respectively disengaging or engaging the coupling of any spring resistance to the reciprocating exercise platform 106, and the instructions are received by the actuator 204 when the reciprocating exercise platform 106 is moving or otherwise positioned anywhere on the resistance exercise machine 100 other than the default starting position, the mechanical execution of the controller 203 instructions will wait until the reciprocating platform 106 has returned to the start position. The execution will therefore occur instantly during the short time period that the reciprocating exercise platform 106 has momentarily stopped at the end of one cycle prior to reversing direction to start another reciprocal cycle.

FIG. 20 is an exemplary diagram showing an exemplary resistance selection table 210. Presented merely as a representative example of the large array of resistance forces of an eight-spring exercise machine 100 that may be removably applied to a reciprocating exercise platform 106, various weight equivalent springs 123 are associated with each selector switch 211, the illustrative weights associated with each switch 119 being designated in the example as either 8 lbs. or 48 lbs. The total desired resistance 213 for any given exercise and/or exerciser 300 is the sum of the weight equivalents of the engaged springs 123. For instance, to achieve a total resistance of 16 lbs. acting upon the reciprocating platform 106, Switch #1 and Switch #3 shown on the row of available switches 212 would be slid into the "ON" position, either manually by the exerciser 300, or via instructions received by the linear actuator 204.

As can be seen, the representative weight variations approach 200 different weight combinations provided by changing the state of eight selector switches 119 to engaged/on, and/or disengaged/oft this vast number of combinations being substantially increased or decreased by providing a different combination of varying spring weights, or modifying the number of the plurality of resistance biasing assemblies on the machine. Therefore, describing every possible combination of switch number and spring weights to engage or disengage would be overly burdensome, but would nonetheless reinforce the commercial and functional value of the methods of instantly and simultaneously controlling the plurality of actuators 204 on a plurality of resistance exercise machines 100 during an exercise training class as fully described above.

The method of varying the exercise resistance level of a resistance exercise machine 100 as described above comprises a plurality of resistance springs 123, each spring 123 engaged or disengaged from a reciprocating exercise platform 106 by one or more slide switches 119. The slide switches 119 may be manipulated manually, or by actuators 134 that extend or retract in response to instructions received from a controller 203.

One important safety function prevents the engagement or disengagement of any resistance spring 123 to or from a reciprocating platform 106 during the performance of an exercise unless the reciprocating platform 106 is at least momentarily stopped at the default starting point of the reciprocating cycle, regardless of when controller 203 instructions are received, or regardless of when a switch 119 is manually manipulated by the exerciser 300. Further, another feature of the invention provides for any actuator 134 to override any manually engaged or disengaged switch 119, and for the manual override of any actuator 134 engaged or disengaged switch 119.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with resistance selector system, suitable methods and materials are described above. All publications, patent applications, patents, and other references mentioned herein are incorporated by reference in their entirety to the extent allowed by applicable law and regulations. The exercise machine with resistance selector system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a rail;

a first stationary platform connected to the frame and positioned near a first end of the frame;

a movable platform movably positioned upon the rail, wherein the movable platform comprises a first end and a second end opposite the first end of the movable platform;

a first bias member selectively connectable to the movable platform to apply a first resistance force upon the movable platform;

a first switch connected to the movable platform, wherein the first switch has an engaged position and a disengaged position; and a first latch adapted to be selectively connectable to the first bias member, wherein the first latch has an engaged position and a disengaged position, wherein the first latch is adapted to be manipulated by the first switch into the engaged position or the disengaged position, wherein the first latch is connected to the first bias member so as to apply the first resistance force upon the movable platform when the first latch is in the engaged position, and wherein the first latch is not connected to the first bias member when the first latch is in the disengaged position;

wherein the first switch comprises a magnet, wherein the magnet of the first switch is adapted to magnetically attract the first latch when the first switch is in the engaged position.

2. The exercise machine of claim 1, wherein the first switch is slidable between the engaged position and the disengaged position.

3. The exercise machine of claim 1, wherein the first latch is adapted to pivot between the engaged position and the disengaged position.

4. The exercise machine of claim 1, comprising a first actuator connected to the first switch, wherein the first actuator is adapted to adjust the first switch between the engaged position and the disengaged position.

5. The exercise machine of claim 4, comprising a remote control for controlling the first actuator.

6. The exercise machine of claim 1, wherein the first latch comprises a ferromagnetic latch handle, wherein the magnet magnetically attracts the ferromagnetic latch handle when the first switch is in the engaged position.

7. The exercise machine of claim 1, further comprising:

a second bias member selectively connectable to the movable platform;

a second switch having an engaged position and a disengaged position, wherein the second switch is connected to the movable platform; and a second latch having an engaged position and a disengaged position, wherein the second latch is adapted to be manipulated by the second switch into the engaged position or the disengaged position, wherein the second latch is connected to the second bias member when the second latch is in the engaged position, wherein the second latch is not connected to the second bias member when the second latch is in the disengaged position.

8. The exercise machine of claim 7, comprising a first actuator connected to the first switch and a second actuator connected to the second switch, wherein the first actuator is adapted to adjust the first switch between the engaged position and the disengaged position, wherein the second actuator is adapted to adjust the second switch between the engaged position and the disengaged position.

9. The exercise machine of claim 7, wherein the second switch comprises a magnet, wherein the magnet of the second switch is adapted to magnetically attract the second latch when the second switch is in the engaged position.

10. An exercise machine, comprising:

a frame having a rail;

a first stationary platform connected to the frame and positioned near a first end of the frame;

a movable platform movably positioned upon the rail, wherein the movable platform comprises a first end and a second end opposite the first end of the movable platform;

a first bias member selectively connectable to the movable platform to apply a first resistance force upon the movable platform;

a first latch adapted to be selectively connectable to the first bias member, wherein the first latch has an engaged position and a disengaged position, wherein the first latch is connected to the first bias member so as to apply the first resistance force upon the movable platform when the first latch is in the engaged position, and wherein the first latch is not connected to the first bias member when the first latch is in the disengaged position; and a first magnet movably connected to the movable platform, wherein the first magnet has an engaged position and a disengaged position, wherein the first magnet is adapted to magnetically attract the first latch when the first magnet is in the engaged position, and wherein the first latch is adapted to be manipulated by the first magnet into the engaged position.

11. The exercise machine of claim 10, wherein the first magnet is slidable between the engaged position and the disengaged position.

12. The exercise machine of claim 10, wherein the first latch is adapted to pivot between the engaged position and the disengaged position.

13. The exercise machine of claim 10, further comprising a first actuator connected to the first magnet.

14. The exercise machine of claim 13, wherein the first actuator is adapted to adjust the first magnet between the engaged position and the disengaged position.

15. The exercise machine of claim 13, wherein the first actuator is comprised of a solenoid.

16. The exercise machine of claim 13, comprising a remote control for controlling the first actuator.

17. The exercise machine of claim 10, further comprising a first switch connected to the first magnet, wherein the first switch has an engaged position and a disengaged position.

18. The exercise machine of claim 10, a second stationary platform connected to the frame and positioned near a second end of the frame.

19. The exercise machine of claim 10, further comprising:

a second bias member selectively connectable to the movable platform;

a second magnet having an engaged position and a disengaged position, wherein the second magnet is connected to the movable platform; and a second latch having an engaged position and a disengaged position, wherein the second latch is adapted to be manipulated by the second magnet into the engaged position, wherein the second latch is connected to the second bias member when the second latch is in the engaged position, wherein the second latch is not connected to the second bias member when the second latch is in the disengaged position; and wherein the second magnet is adapted to magnetically attract the second latch when the second magnet is in the engaged position.

20. An exercise machine, comprising:

a frame having a first rail and a second rail, wherein the second rail is parallel to the first rail;

a stationary platform connected to the frame and positioned near a first end of the frame;

a movable platform movably positioned upon the first rail and the second rail, wherein the movable platform comprises a first end and a second end opposite the first end of the movable platform;

a first bias member selectively connectable to the movable platform to apply a first resistance force upon the movable platform;

a first latch adapted to be selectively connectable to the first bias member, wherein the first latch has an engaged position and a disengaged position, wherein the first latch is connected to the first bias member so as to apply the first resistance force upon the movable platform when the first latch is in the engaged position, and wherein the first latch is not connected to the first bias member when the first latch is in the disengaged position;

a first magnet movably connected to the movable platform, wherein the first magnet has an engaged position and a disengaged position, wherein the first magnet is adapted to magnetically attract the first latch when the first magnet is in the engaged position, wherein the first latch is adapted to be manipulated by the first magnet into the engaged position, and wherein the first magnet is slidable between the engaged position and the disengaged position;

a first actuator connected to the first magnet, wherein the first actuator is adapted to adjust the first magnet between the engaged position and the disengaged position;

a second bias member selectively connectable to the movable platform to apply a second resistance force upon the movable platform;

a second latch adapted to be selectively connectable to the second bias member, wherein the second latch has an engaged position and a disengaged position, wherein the second latch is connected to the second bias member so as to apply the second resistance force upon the movable platform when the second latch is in the engaged position, and wherein the second latch is not connected to the second bias member when the second latch is in the disengaged position;

a second magnet movably connected to the movable platform, wherein the second magnet has an engaged position and a disengaged position, wherein the second magnet is adapted to magnetically attract the second latch when the second magnet is in the engaged position, wherein the second latch is adapted to be manipulated by the second magnet into the engaged position, and wherein the second magnet is slidable between the engaged position and the disengaged position;

a second actuator connected to the second magnet, wherein the second actuator is adapted to adjust the second magnet between the engaged position and the disengaged position; and a remote control for controlling the first actuator and the second actuator.

* * * * *